US011475822B2

(12) United States Patent
Furihata et al.

(10) Patent No.: US 11,475,822 B2
(45) Date of Patent: Oct. 18, 2022

(54) SYSTEM AND METHOD FOR SUBPIXEL RENDERING AND DISPLAY DRIVER

(71) Applicant: Synaptics Japan GK, Tokyo (JP)

(72) Inventors: Hirobumi Furihata, Tokyo (JP); Tomoo Minaki, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 267 days.

(21) Appl. No.: 15/930,011

(22) Filed: May 12, 2020

(65) Prior Publication Data

US 2020/0273395 A1 Aug. 27, 2020

Related U.S. Application Data

(63) Continuation of application No. 15/868,317, filed on Jan. 11, 2018.

(30) Foreign Application Priority Data

Jan. 12, 2017 (JP) ..... JP2017003271
Jan. 13, 2017 (JP) ..... JP2017004528

(51) Int. Cl.
*G09G 3/20* (2006.01)

(52) U.S. Cl.
CPC ..... *G09G 3/2077* (2013.01); *G09G 3/20* (2013.01); *G09G 3/2044* (2013.01);
(Continued)

(58) Field of Classification Search
CPC ... G09G 3/2077; G09G 3/2044; G09G 3/2074
See application file for complete search history.

(56) References Cited

U.S. PATENT DOCUMENTS 5,189,407 A 2/1993 Mano et al.
5,563,623 A * 10/1996 Barrett, Jr. ..... G09G 3/3625 345/97

(Continued)

FOREIGN PATENT DOCUMENTS

JP H09101771 A 4/1997
JP 2002208018 A 7/2002
JP 2011118000 A 6/2011

OTHER PUBLICATIONS

Notice of Reasons for Refusal, with translation, issued for Japanese Patent Application ON. 2017-004528, dated Jun. 10, 2021, 4 pages.

(Continued)

*Primary Examiner* — William Boddie
*Assistant Examiner* — Andrew B Schnirel
(74) *Attorney, Agent, or Firm* — Ferguson Braswell Fraser Kubasta PC

(57) ABSTRACT

A system and method for rendering subpixels comprising performing an eight-color halftoning process on the second image data to generate third image data which describe a grayscale value of each of an R subpixel, a G subpixel and a B subpixel of each pixel with one bit, generating the third image data by performing a dithering process on the second image data using a dither value selected from elements of the dither table, when the third image data associated with a pixel of interest of the display panel is generated, and driving the display panel in response to the third image data.

20 Claims, 16 Drawing Sheets

(52) U.S. Cl.
CPC ... *G09G 3/2074* (2013.01); *G09G 2300/0443* (2013.01); *G09G 2320/0242* (2013.01); *G09G 2320/0673* (2013.01); *G09G 2340/0457* (2013.01)

(56) References Cited

U.S. PATENT DOCUMENTS

| | | | | |
|---|---|---|---|---|
| 5,598,179 | A * | 1/1997 | Orlen | G09G 3/3625 345/94 |
| 5,644,329 | A | 7/1997 | Asari et al. | |
| 6,496,536 | B2 * | 12/2002 | Mollenkopf | H04B 7/18543 370/318 |
| 7,248,268 | B2 | 7/2007 | Brown Elliott et al. | |
| 7,598,965 | B2 | 10/2009 | Brown Elliott et al. | |
| 7,920,154 | B2 | 4/2011 | Brown Elliott et al. | |
| 8,390,646 | B2 | 3/2013 | Brown Elliott et al. | |
| 2006/0038920 | A1 | 2/2006 | Kondo et al. | |
| 2006/0209054 | A1 | 9/2006 | Someya et al. | |
| 2012/0281028 | A1 * | 11/2012 | Orlick | G09G 3/3426 345/102 |
| 2016/0379543 | A1 | 12/2016 | Furihata et al. | |
| 2017/0061847 | A1 | 3/2017 | Kim et al. | |
| 2017/0236466 | A1 | 8/2017 | Spitzer et al. | |
| 2021/0210009 | A1 * | 7/2021 | Jun | G09G 3/3208 |
| 2022/0208069 | A1 * | 6/2022 | Jun | G09G 3/3225 |

OTHER PUBLICATIONS

Notice of Reasons for Refusal, with translation, issued for corresponding Japanese Patent Application No. 2017-004528, dated Jan. 12, 2022 (4 pages).

* cited by examiner

Fig. 5

| γ | α |
|---|---|
| 2.0 | – |
| 2.1 | 85 |
| 2.2 | 44 |
| 2.3 | 31 |
| 2.4 | 24 |
| 2.5 | 20 |
| 2.6 | 17 |
| 2.7 | 15 |
| 2.8 | 14 |
| 2.9 | 13 |
| 3.0 | 12 |

Fig. 9

| Y[3:0] \ X[3:0] | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 0 | 159 | 32 | 191 | 64 | 223 | 96 | 255 | 127 | 224 | 95 | 192 | 63 | 160 | 31 | 128 |
| 1 | 216 | 71 | 184 | 39 | 152 | 7 | 135 | 24 | 167 | 56 | 199 | 88 | 231 | 120 | 248 | 103 |
| 2 | 110 | 241 | 113 | 238 | 81 | 206 | 49 | 174 | 17 | 142 | 14 | 145 | 46 | 177 | 78 | 209 |
| 3 | 154 | 5 | 133 | 26 | 165 | 58 | 197 | 90 | 229 | 122 | 250 | 101 | 218 | 69 | 186 | 37 |
| 4 | 83 | 204 | 51 | 172 | 19 | 140 | 12 | 147 | 44 | 179 | 76 | 211 | 108 | 243 | 115 | 236 |
| 5 | 163 | 60 | 195 | 92 | 227 | 124 | 252 | 99 | 220 | 67 | 188 | 35 | 156 | 3 | 131 | 28 |
| 6 | 21 | 138 | 10 | 149 | 42 | 181 | 74 | 213 | 106 | 245 | 117 | 234 | 85 | 202 | 53 | 170 |
| 7 | 225 | 126 | 254 | 97 | 222 | 65 | 190 | 33 | 158 | 1 | 129 | 30 | 161 | 62 | 193 | 94 |
| 8 | 40 | 183 | 72 | 215 | 104 | 247 | 119 | 232 | 87 | 200 | 55 | 168 | 23 | 136 | 8 | 151 |
| 9 | 176 | 47 | 144 | 15 | 143 | 16 | 175 | 48 | 207 | 80 | 239 | 112 | 240 | 111 | 208 | 79 |
| 10 | 70 | 217 | 102 | 249 | 121 | 230 | 89 | 198 | 57 | 166 | 25 | 134 | 6 | 153 | 38 | 185 |
| 11 | 141 | 18 | 173 | 50 | 205 | 82 | 237 | 114 | 242 | 109 | 210 | 77 | 178 | 45 | 146 | 13 |
| 12 | 123 | 228 | 91 | 196 | 59 | 164 | 27 | 132 | 4 | 155 | 36 | 187 | 68 | 219 | 100 | 251 |
| 13 | 203 | 84 | 235 | 116 | 244 | 107 | 212 | 75 | 180 | 43 | 148 | 11 | 139 | 20 | 171 | 52 |
| 14 | 61 | 162 | 29 | 130 | 2 | 157 | 34 | 189 | 66 | 221 | 98 | 253 | 125 | 226 | 93 | 194 |
| 15 | 246 | 105 | 214 | 73 | 182 | 41 | 150 | 9 | 137 | 22 | 169 | 54 | 201 | 86 | 233 | 118 |

Fig. 12

53

X[3:0]

| Y[3:0] | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| 0 | 1 | 92 | 16 | 119 | 32 | 156 | 50 | 241 | 69 | 157 | 49 | 120 | 31 | 93 | 15 | 70 |
| 1 | 146 | 36 | 113 | 19 | 87 | 4 | 74 | 12 | 98 | 28 | 127 | 45 | 168 | 65 | 204 | 54 |
| 2 | 58 | 186 | 60 | 180 | 41 | 135 | 24 | 104 | 9 | 79 | 7 | 81 | 23 | 106 | 40 | 138 |
| 3 | 88 | 3 | 73 | 13 | 97 | 29 | 125 | 46 | 165 | 66 | 211 | 53 | 149 | 35 | 115 | 18 |
| 4 | 42 | 132 | 25 | 102 | 10 | 78 | 6 | 83 | 22 | 108 | 38 | 140 | 57 | 191 | 61 | 176 |
| 5 | 95 | 30 | 123 | 48 | 161 | 67 | 219 | 52 | 152 | 34 | 116 | 17 | 90 | 2 | 72 | 14 |
| 6 | 10 | 77 | 5 | 84 | 21 | 110 | 37 | 143 | 56 | 196 | 63 | 173 | 44 | 130 | 26 | 101 |
| 7 | 159 | 68 | 231 | 50 | 154 | 33 | 118 | 16 | 91 | 1 | 70 | 15 | 93 | 31 | 121 | 49 |
| 8 | 20 | 112 | 36 | 145 | 55 | 201 | 64 | 169 | 45 | 128 | 27 | 99 | 11 | 75 | 4 | 86 |
| 9 | 106 | 23 | 81 | 8 | 80 | 8 | 105 | 24 | 136 | 41 | 182 | 59 | 184 | 59 | 137 | 40 |
| 10 | 35 | 148 | 53 | 207 | 65 | 166 | 46 | 126 | 28 | 97 | 12 | 74 | 3 | 87 | 19 | 114 |
| 11 | 79 | 9 | 103 | 25 | 134 | 42 | 178 | 61 | 189 | 58 | 139 | 39 | 107 | 22 | 82 | 7 |
| 12 | 66 | 163 | 47 | 124 | 29 | 96 | 13 | 72 | 3 | 89 | 18 | 115 | 34 | 150 | 52 | 215 |
| 13 | 131 | 43 | 175 | 62 | 193 | 56 | 142 | 38 | 109 | 21 | 84 | 6 | 77 | 10 | 101 | 26 |
| 14 | 30 | 94 | 14 | 71 | 2 | 90 | 17 | 117 | 33 | 153 | 51 | 224 | 68 | 160 | 48 | 122 |
| 15 | 198 | 55 | 144 | 37 | 111 | 20 | 85 | 5 | 76 | 11 | 100 | 27 | 129 | 44 | 171 | 63 |

SYSTEM AND METHOD FOR SUBPIXEL RENDERING AND DISPLAY DRIVER

CROSS REFERENCE

This application is a continuation of U.S. patent application Ser. No. 15/868,317 filed Jan. 11, 2018, which claims priority of Japanese Patent Application No. 2017-003271, filed on Jan. 12, 2017, and Japanese Patent Application No. 2017-004528, filed on Jan. 13, 2017, the disclosures of which are incorporated herein by reference.

TECHNICAL FIELD

The present disclosure relates to a display driver, a display device and an image processing circuitry, more particularly, to subpixel rendering.

BACKGROUND ART

The subpixel rendering is a technique for displaying an image with a resolution higher than the original resolution of a display device, such as OLED (organic light emitting diode) display panels and LCD (liquid crystal display) panels, by performing image data processing on image data of the original image. In the following, image data process for achieving subpixel rendering may be referred to as subpixel rendering process. A subpixel rendering process involves generating image data used for driving M pixels of a display device from image data associated with N pixels of the original image, where N and M are natural numbers satisfying N>M.

A subpixel rendering process is achieved in light of gamma characteristics of the display device. Discussed below is the case where image data used for driving one pixel of a display device is generated from image data associated with two pixels of the original image through a subpixel rendering process, while the grayscale value of each subpixel is represented by eight bits in the image data of the original image and the image data used for driving each pixel of the display device. When the grayscale values of the R subpixels of first and second pixels are described as being "255" and "0", respectively, in the image data of the original image, and the grayscale value of the R subpixel of the corresponding pixel of the display device is calculated by simply averaging the grayscale values of the R subpixels of first and second pixels in the subpixel rendering process, the result is a grayscale value of "127.5". When the R subpixel of the corresponding pixel of the display device is driven with the grayscale value of "127.5", the brightness of the R subpixel becomes 22% for a gamma value $\gamma$ of 2.2. However, in one embodiment, the R subpixel of the corresponding pixel of the display device is driven so that the brightness of the R subpixel becomes 50%, since the grayscale value of "255" corresponds to the brightness of 100% and the grayscale value of "0" corresponds to the brightness of 0%. When the gamma value $\gamma$ of the display device is 2.2, the grayscale value of the R subpixel of the corresponding pixel of the display device is calculated as "186" in the subpixel rendering process.

Accordingly, a subpixel rendering process generally includes performing gamma conversion on the grayscale values described in image data of the original image (that is, calculating the $\gamma$ powers of the grayscale values of the image data), calculating image data associated with M pixels of the display device on the basis of the image data obtained by the gamma conversion, and then performing inverse gamma conversion (that is, calculating the $1/\gamma$ powers of the grayscale values of the image data).

Such subpixel rendering process may cause an increase in the circuit size. The gamma conversion and the inverse gamma conversion involve calculation of a power. As widely known to persons skilled in the art, a circuit performing calculation of a power has a large circuit size. For example, to perform a gamma conversion or an inverse gamma conversion is to use an LUT (lookup table); however, use of an LUT to achieve gamma conversion or inverse gamma conversion increases the circuit size.

Thus, there is a technical need of reducing the circuit size of a circuit which performs a subpixel rendering process.

SUMMARY

In one embodiment, a display driver includes: a subpixel rendering circuitry configured to generate, from input image data describing input grayscale values which are grayscale values of subpixels of N pixels of an input image, output image data describing output grayscale values which are grayscale values of subpixels of M corresponding pixels of an output image corresponding to the N pixels of the input image, N being an integer of two or more and M being an integer satisfying $1 \leq M < N$; and a drive circuitry configured to drive a display panel in response to the output image data. The subpixel rendering circuitry is configured to calculate input-side squared grayscale values which are squares of the input grayscale values for the respective N pixels of the input image, calculate correction values associated with the M corresponding pixels from a correction parameter determined in response to a gamma value set to the display driver and the input grayscale values, and generate the output image data by processing the input-side squared grayscale values based on the correction values.

In another embodiment, an image processing circuitry includes a subpixel rendering circuitry configured to generate, from input image data describing input grayscale values associated with N pixels of an input image, output image data describing output grayscale values associated with M corresponding pixels of an output image corresponding to the N pixels of the input image, N being an integer of two or more and M being an integer satisfying $1 \leq M < N$. The subpixel rendering circuitry includes: a square calculation circuitry configured to calculate input-side squared grayscale values which are squares of the input grayscale values for the respective N pixels of the input image, and a processing circuitry configured to calculate correction values associated with the M corresponding pixels from a correction parameter determined in response to a gamma value set to the display driver and the input grayscale values, and generate the output image data by processing the input-side squared grayscale values based on the correction values.

In still another embodiment, a display device includes a display panel and a display driver driving the display panel. The display driver includes: a subpixel rendering circuitry configured to generate, from input image data describing input grayscale values associated with N pixels of an input image, output image data describing output grayscale values associated with M corresponding pixels of an output image corresponding to the N pixels of the input image, N being an integer of two or more and M being an integer satisfying $1 \leq M < N$; and a drive circuitry configured to drive the display panel in response to the output image data. The subpixel rendering circuitry is configured to calculate input-side squared grayscale values which are squares of the input grayscale values for the respective N pixels of the input image, calculate correction values associated with the M corresponding pixels from a correction parameter determined in response to a gamma value set to the display driver and the input grayscale values, and generate the output image data by processing the input-side squared grayscale values based on the correction values.

In still another embodiment, a display driver for driving a display panel includes: a subpixel rendering circuitry configured to perform a subpixel rendering process on first image data to generate second image data; an eight-color halftoning circuitry configured to perform an eight-color halftoning process on the second image data to generate third image data which describe a grayscale value of each of an R subpixel, a G subpixel and a B subpixel of each pixel with one bit; and a drive circuitry configured to drive the display panel in response to the third image data. The eight-color halftoning circuitry includes a storage circuitry configured to store a dither table, and is configured to generate the third image data by performing a dithering process on the second image data using a dither value selected from elements of a dither table. The frequency distribution of values of the elements of the dither table is uneven.

In still another embodiment, a display device includes a display panel and a display driver. The display driver includes a subpixel rendering circuitry configured to perform a subpixel rendering process on first image data to generate second image data; an eight-color halftoning circuitry configured to perform an eight-color halftoning process on the second image data to generate third image data which describe a grayscale value of each of an R subpixel, a G subpixel and a B subpixel of each pixel with one bit; and a drive circuitry configured to drive the display panel in response to the third image data. The eight-color halftoning circuitry includes a storage circuitry configured to store a dither table, and is configured to generate the third image data by performing a dithering process on the second image data using a dither value selected from elements of a dither table, when the third image data associated with a pixel of interest of the display panel is generated. The frequency distribution of values of the elements of the dither table is uneven.

BRIEF DESCRIPTION OF THE DRAWINGS

FIG. 5 is a table illustrating the correspondence between the gamma value $\gamma$ and the correction parameter $\alpha$ according to one or more embodiments;

FIG. 9 illustrates one example of a dither table according to one or more embodiments;

FIG. 12 illustrates one example of a dither table according to one or more embodiments.

DETAILED DESCRIPTION

Figure 1A:
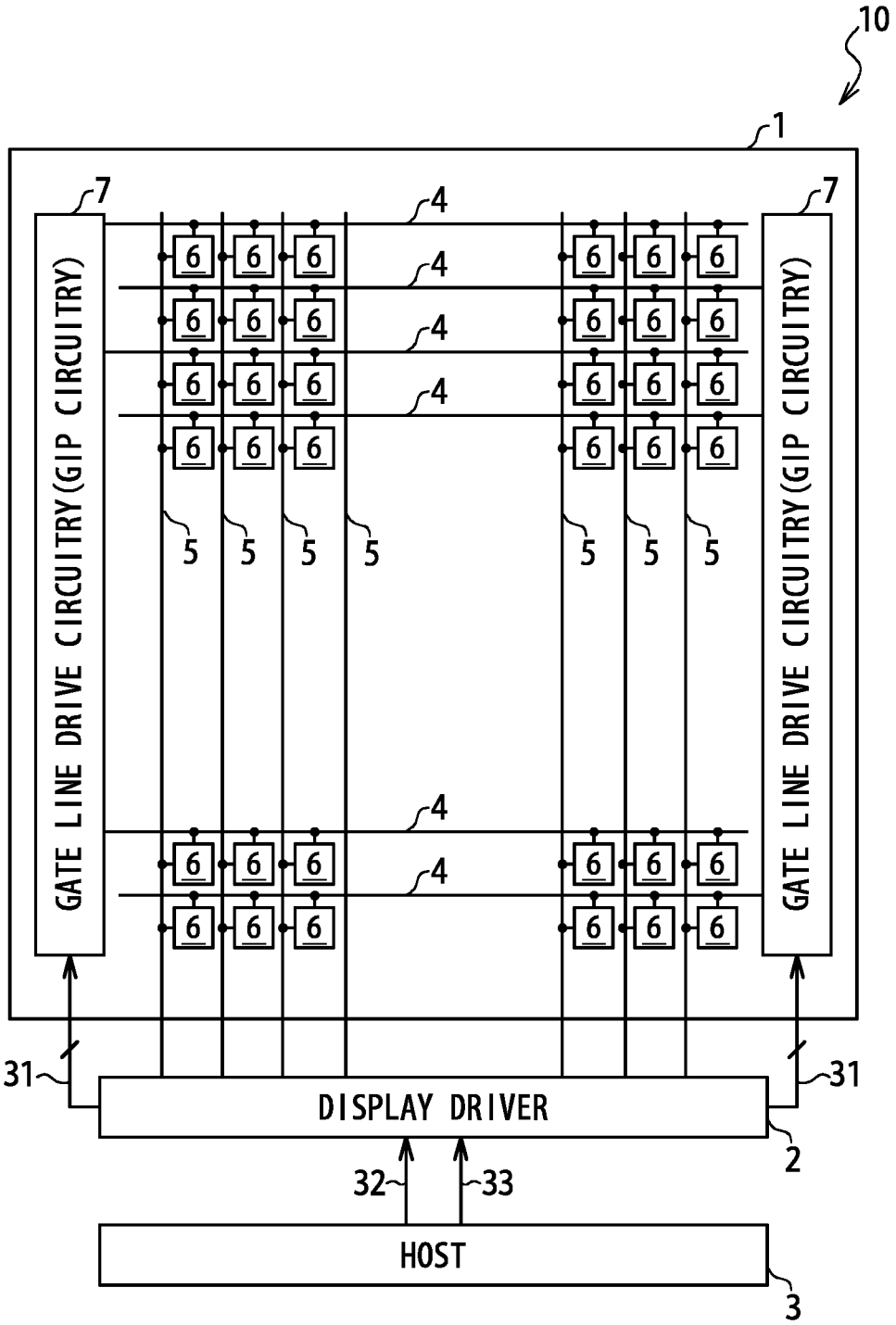
FIG. 1A is a block diagram illustrating the configuration of a display device according to one or more embodiments.

In the following, a description is given of embodiments of the present disclosure with reference to the attached drawings. FIG. 1A is a block diagram illustrating the configuration of a display device 10 in one embodiment. The display device 10 includes a display panel 1 and a display driver 2. An OLED (organic light emitting diode) display panel or a liquid crystal display panel may be used as the display panel 1.

The display panel 1 includes gate lines 4, data lines 5, pixel circuits 6 and gate line drive circuitries 7. Each pixel circuit 6 is disposed at an intersection of a gate line 4 and a data line 5 and configured to display one of the red, green and blue colors. Pixel circuits 6 which display the red color are used as R subpixels. Similarly, pixel circuits 6 which display the green color are used as G subpixels, and pixel circuits 6 which display the blue color are used as B subpixels. When an OLED display panel is used as the display panel 1, in one embodiment, the pixel circuits 6 which display the red color may include an light emitting element which emits red light, the pixel circuits 6 which display the green color may include an light emitting element which emits green light, and the pixel circuits 6 which display the blue color may include an light emitting element which emits blue light.

Figure 1B:
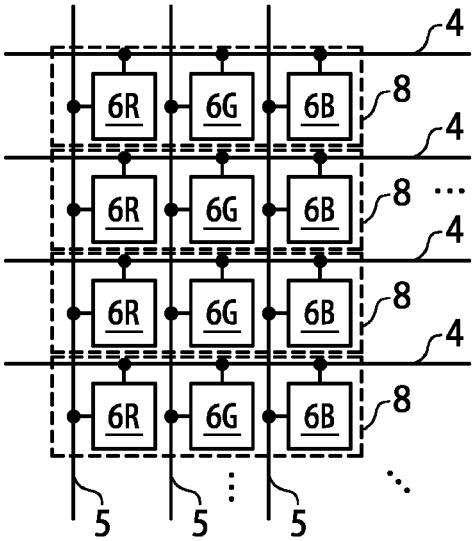
FIG. 1B illustrates the configuration of a pixel according to one or more embodiments.

As illustrated in FIG. 1B, each pixel 8 of the display panel 1 includes one R subpixel, one G subpixel and one B subpixel. In FIG. 1B, the R subpixels (pixel circuits 6 displaying the red color) are denoted by numeral 6R. Similarly, the G subpixels (pixel circuits 6 displaying the green color) are denoted by numeral 6G and the B subpixels (pixel circuits 6 displaying the blue color) are denoted by numeral 6B.

Referring back to FIG. 1A, the gate line drive circuitries 7 drive the gate lines 4 in response to gate control signals 31 received from the display driver 2. In this embodiment, a pair of gate line drive circuitries 7 is provided. One of the gate line drive circuitries 7 drives the odd-numbered gate lines 4 and the other drives the even-numbered gate lines 4. In this embodiment, the gate line drive circuitries 7 are integrated on the display panel 1 by using a GIP (gate-in-panel) technology. Such gate line drive circuitries 7 may be referred to as GIP circuitries.

The display driver 2 drives the display panel 1 in response to image data 32 and control data 33 received from a host 3 to display images on the display panel 1. The image data 32 describe the grayscale value of each subpixel of each pixel of an image to be displayed (or an original image). The control data 33 include commands and parameters used for controlling the display driver 2. An application processor, a CPU (central processing unit), a DSP (digital signal processor) or the like may be used as the host 3.

Figure 1C:
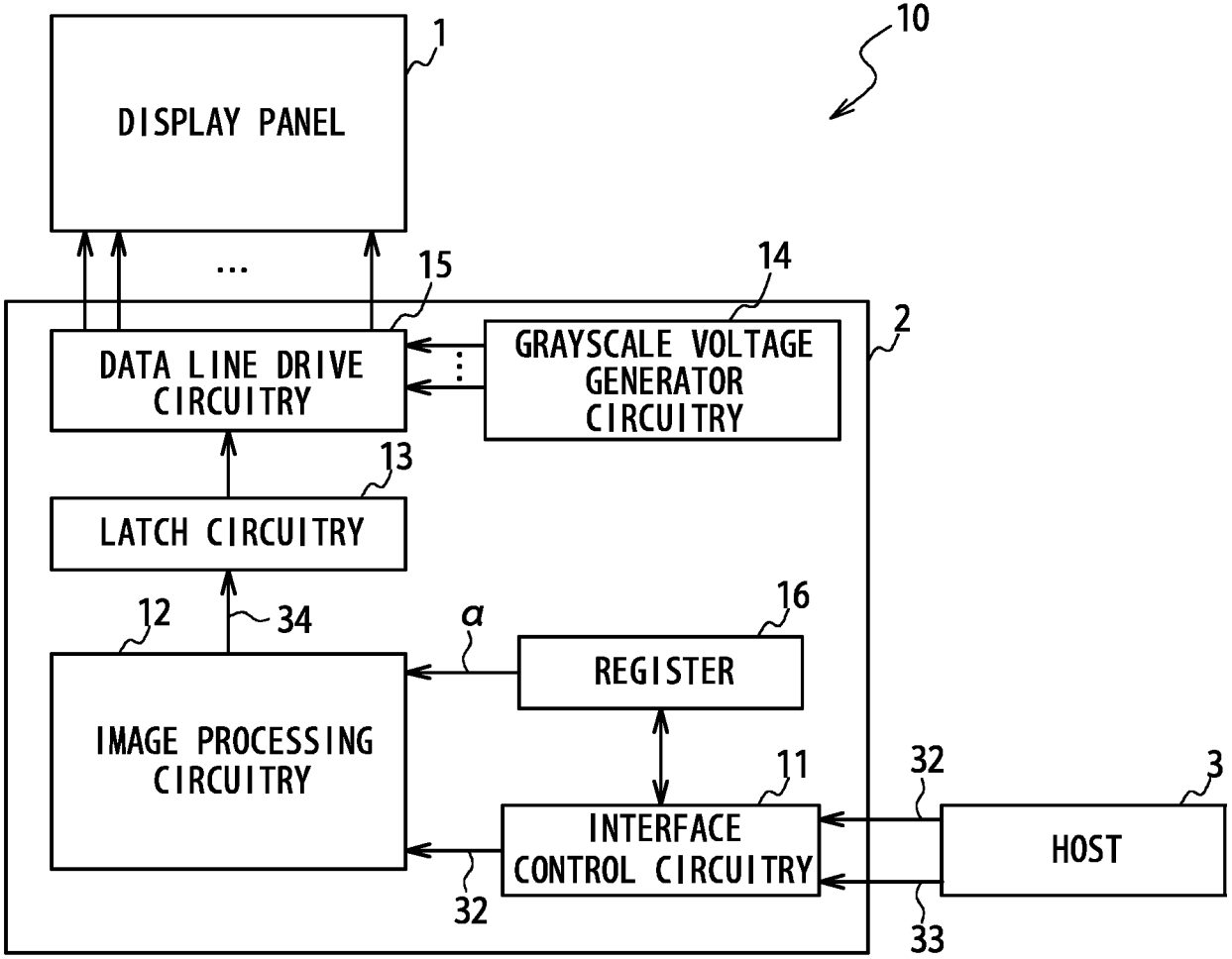
FIG. 1C is a block diagram illustrating the configuration of a display driver according to one or more embodiments.

FIG. 1C is a block diagram illustrating the configuration of the display driver 2 in one embodiment. The display driver 2 includes an interface control circuitry 11, an image processing circuitry 12, a latch circuitry 13, a grayscale voltage generator circuitry 14, a data line drive circuitry 15 and a register 16.

The interface control circuitry 11 operates as follows. First, the interface control circuitry 11 forwards the image data 32 received from the host 3 to the image processing circuitry 12. The interface control circuitry 11 further stores various parameters included in the control data 33 into the register 16 and controls the respective circuitries of the display driver 2 in response to commands included in the control data 33.

The image processing circuitry 12 performs a desired image data process on the image data 32 received from the interface control circuitry 11 to generate display data 34 used for driving the display panel 1. As described later In one embodiment, the image data process performed in the image processing circuitry 12 includes a subpixel rendering process. Details of the subpixel rendering process performed in the image processing circuitry 12 will be described later. The image data process performed in the image processing circuitry 12 may include processes other than the subpixel rendering process (e.g. color adjustment).

The latch circuitry 13 latches the display data 34 from the image processing circuitry 12 and forwards the latched display data 34 to the data line drive circuitry 15.

The grayscale voltage generator circuitry 14 generates a set of grayscale voltages respectively corresponding to the allowed values of the grayscale values described in the display data 34.

The data line drive circuitry 15 drives the respective data lines 5 with the grayscale voltages corresponding to the values of the display data 34. In one embodiment, the data line drive circuitry 15 selects ones of the grayscale voltages received from the grayscale voltage generator circuitry 14 corresponding to the values of the display data 34, and drives the respective data lines 5 to the selected grayscale voltages.

The register 16 stores therein various control parameters used to control the operation of the display driver 2. The register 16 is configured to be rewritable from outside of the display driver 2, for example, from the host 3. The control parameters stored in the register 16 include a correction parameter $\alpha$ used to control the subpixel rendering process performed in the image processing circuitry 12. The content and technical meaning of the correction parameter $\alpha$ will be described later In one embodiment.

Figure 2:
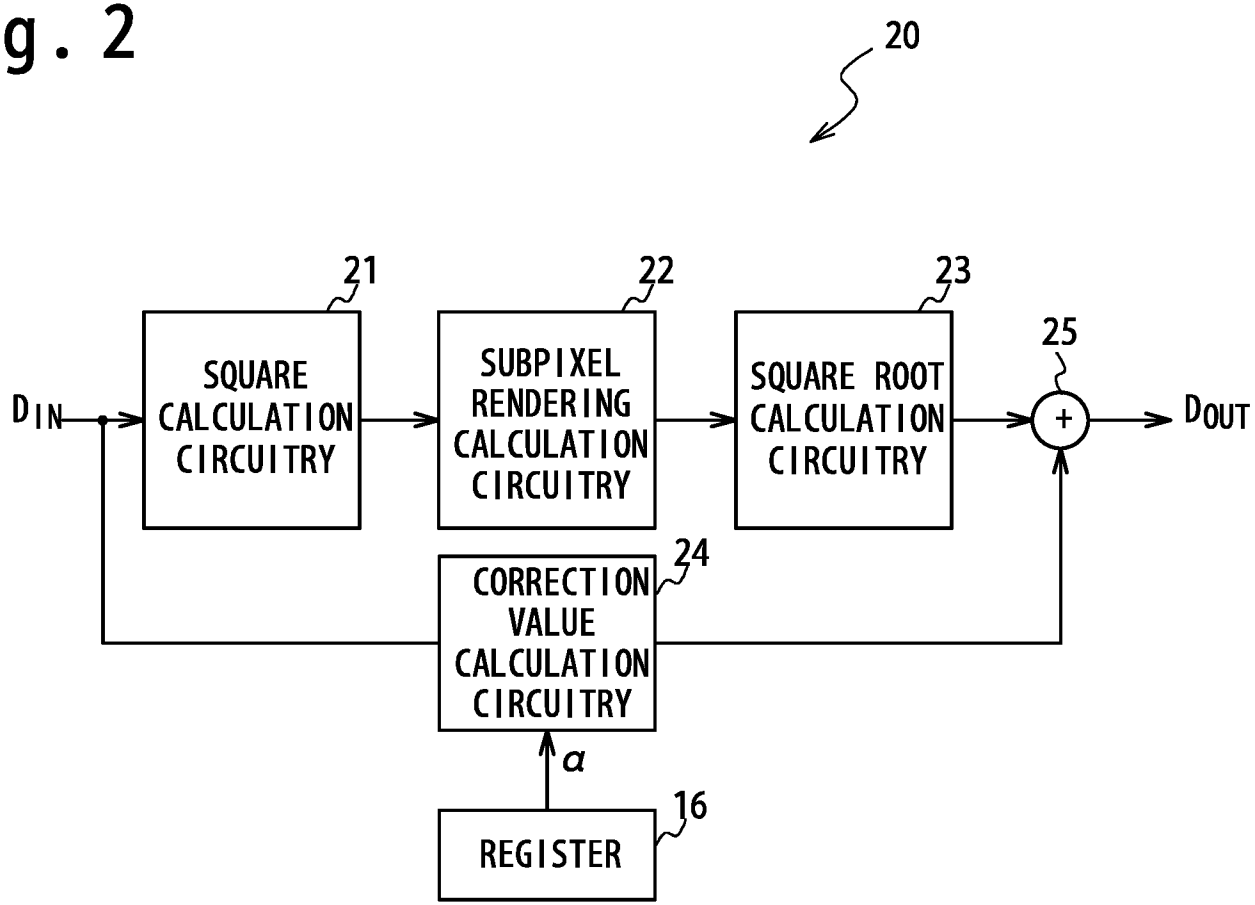
FIG. 2 is a block diagram illustrating the configuration of a subpixel rendering circuitry according to one or more embodiments.

FIG. 2 is a block diagram illustrating the configuration of a circuitry which performs the subpixel rendering process in the image processing circuitry 12. In the following, the circuitry performing the subpixel rendering process is referred to as the subpixel rendering circuitry 20. The subpixel rendering circuitry 20 is configured to perform the subpixel rendering process on input image data $D_{IN}$ to generate output image data $D_{OUT}$. In the following, the image corresponding to the input image data $D_{IN}$ is referred to as the input image, and the image corresponding to the output image data is referred to as the output image. The input image data $D_{IN}$ describe the grayscale value of each subpixel (the R subpixel, G subpixel, and B subpixel) of each pixel of the input image. The grayscale value of each subpixel described in the input image data $D_{IN}$ may be referred to as the input grayscale value. The output image data $D_{OUT}$, on the other hand, describe the grayscale value of each subpixel (the R subpixel, G subpixel and B subpixel) of each pixel of the output image. The grayscale value of each subpixel described in the output image data $D_{OUT}$ may be referred to as the output grayscale value.

The input image data $D_{IN}$ supplied to the subpixel rendering circuitry 20 may be the image data 32 supplied to the image processing circuitry 12 from the interface control circuitry 11. Alternatively, image data obtained by performing desired image data processing on the image data 32 may be used as the input image data $D_{IN}$. The output image data $D_{OUT}$ output from the subpixel rendering circuitry 20 may be used as the display data 34 supplied to the data line drive circuitry 15. Alternatively, image data obtained by performing desired image data processing on the output image data $D_{OUT}$ may be used as the display data 34 and supplied to the data line drive circuitry 15.

In this embodiment, the subpixel rendering circuitry 20 includes a square calculation circuitry 21, a subpixel rendering calculation circuitry 22, a square root calculation circuitry 23, a correction value calculation circuitry 24 and an adder circuitry 25.

The square calculation circuitry 21 calculates the square of the input grayscale value for each subpixel of each pixel of the input image. The value of the square of an input grayscale value may be referred to as the input-side squared grayscale value.

The subpixel rendering calculation circuitry 22 calculates SPR-processed (subpixel rendering processed) squared grayscale value for each subpixel of each pixel of the output image, from the input-side squared grayscale value calculated for each subpixel of each pixel of the input image. The SPR-processed squared grayscale value approximately corresponds to the square of the grayscale value of each subpixel of each pixel of the output image. It should be noted however that, as will be understood from the following description, the square root of the SPR-processed squared grayscale value calculated for each subpixel of each pixel of the output image may not be used as the grayscale value of each subpixel of each pixel of the output image. The SPR-processed squared grayscale value of a subpixel of a specific color (for example, red, green or blue) of a specific pixel of the output image is calculated from the input-side squared grayscale values calculated for the subpixels of the specific color of the pixels of the input image corresponding to the specific pixel of the output image.

The square root calculation circuitry 23 calculates the square root (that is, ½ power) of the SPR-processed squared grayscale value calculated for each subpixel of each pixel of the output image.

The correction value calculation circuitry 24 calculates a correction value $\Delta D$ for each subpixel of each pixel of the output image. The correction parameter $\alpha$ stored in the register 16 is used to calculate the correction value $\Delta D$. The calculated correction value $\Delta D$ is supplied to the adder circuitry 25.

The adder circuitry 25 adds the correction value $\Delta D$ calculated for each subpixel of each pixel of the output image to the square root of the SPR-processed squared grayscale value calculated for each subpixel of each pixel of the output image. The output of the adder circuitry 25 is the output image data $D_{OUT}$. The grayscale value of a specific subpixel of a specific pixel of the output image described in the output image data $D_{OUT}$ is calculated as the sum of the square root of the SPR-processed squared grayscale value calculated for the specific subpixel and the correction value ΔD calculated for the specific subpixel.

As described above, a commonly-used subpixel rendering process includes a gamma conversion, an arithmetic process of image data, and an inverse-gamma conversion. The gamma conversion includes calculation of a γ power, and the inverse gamma conversion includes calculation of a 1/γ power, where γ is the gamma value. The circuit size of a circuit which performs the gamma conversion or the inverse gamma conversion is large as described above.

The subpixel rendering circuitry 20 of this embodiment is configured so that square calculation (e.g., calculation to obtain a square) is performed in place of the gamma conversion and square root calculation (e.g., calculation to obtain a square root) is performed in place of the inverse gamma conversion, while the error caused by these calculations is compensated by adding the correction value ΔD. The square calculation and square root calculation can be implemented by a circuit of a smaller circuit size than that of a circuit which calculates a power. Although the use of the square calculation and the square root calculation in place of the gamma conversion and the inverse gamma conversion may cause an error, this error can be compensated by adding the correction value ΔD. Accordingly, the configuration of the subpixel rendering circuitry 20 of this embodiment effectively reduces the circuit size.

In the following, the operation of the subpixel rendering circuitry 20 to generate the output image data $D_{OUT}$ is described for the case where the ratio of the number of the pixels of the input image to that of the output image is 3:2. In other embodiments, other ratios may be used.

Figure 3:
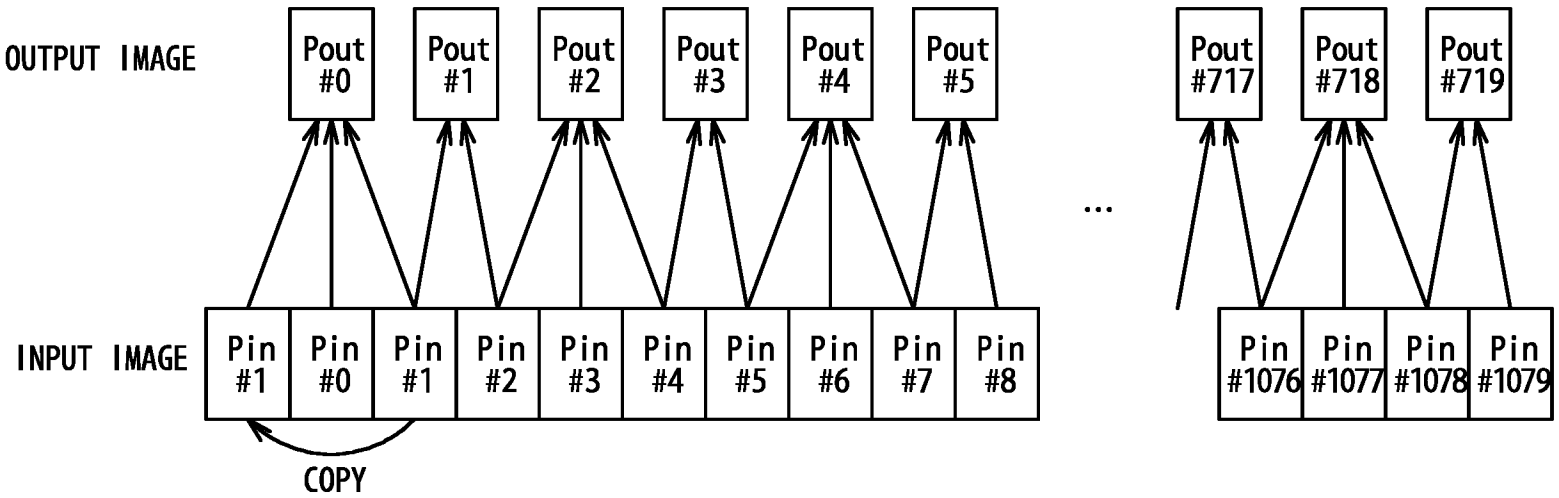
FIG. 3 is a conceptual diagram illustrating the correspondence relationship between pixels according to one or more embodiments.

FIG. 3 schematically illustrates the correspondence relationship between the pixels of the input image and those of the output image, for the case where the ratio of the number of the pixels of the input image to that of the output image is 3:2. Illustrated in FIG. 3 is an example in which output image data $D_{OUT}$ associated with 720 pixels arrayed in the horizontal direction are calculated from input image data $D_{IN}$ associated with 1080 pixels arrayed in the horizontal direction.

In the subpixel rendering process illustrated in FIG. 3, the output image data $D_{OUT}$ are calculated in units of two pixels of the output image, which are adjacent in the horizontal direction (the direction in which the gate lines are extended). Output image data $D_{OUT}$ associated with two adjacent pixels of the output image are calculated from input image data $D_{IN}$ associated with four pixels of the input image. In one embodiment, the output image data $D_{OUT}$ associated with pixel Pout #(2$k$) of the output image is calculated from the input image data $D_{IN}$ associated with pixels Pin #(3$k$−1), Pin #(3$k$) and Pin(3$k$+1) of the input image, and the output image data $D_{OUT}$ associated with pixel Pout #(2$k$+1) of the output image is calculated from the input image data $D_{IN}$ associated with pixels Pin #(3$k$+1) and Pin(3$k$+2) of the input image, in one embodiment k is an integer equal to or greater than zero.

For the case where k is zero, that is, for the calculation of the output image data $D_{OUT}$ associated with the leftmost pixel Pout #0 of the output image, pixel Pin #0 of the input image is positioned leftmost in the horizontal direction and pixel Pin #(−1) does not exist. To address this, the output image data $D_{OUT}$ associated with pixel Pout #0 of the output image is calculated by using the input image data $D_{IN}$ associated with pixel Pin #1, in place of the input image data $D_{IN}$ associated with pixel Pin #(−1). In other words, the output image data $D_{OUT}$ associated with pixel Pout #0 of the output image is calculated from the input image data $D_{IN}$ associated with pixels Pin #1, Pin #0, Pin #1 and Pin #2 of the input image. Also in this case, the output image data $D_{OUT}$ associated with two pixels Pout #0 and #1 of the output image can be virtually considered as being calculated from the input image data $D_{IN}$ associated with four pixels Pin #1, Pin #0, Pin #1 and Pin #2 of the input image.

In various embodiment, the subpixel rendering process performed by the subpixel rendering circuitry 20, comprises calculating the output image data $D_{OUT}$ associated with two pixels Pout #(2$k$) and Pout #(2$k$+1) from the input image data $D_{IN}$ associated with four pixels Pin #(3$k$−1), Pin #(3$k$), Pin #(3$k$+1) and Pin #(3$k$+2). For example, the output image data $D_{OUT}$ of two pixels Pout #2 and Pout #3 of the output image are calculated from four pixels Pin #2, Pin #3, Pin #4 and Pin #5 of the input image in this subpixel rendering process. In various embodiments, for the case where k=0, the input image data $D_{IN}$ associated with pixel Pin #1 is used in place of the input image data $D_{IN}$ associated with pixel Pin #(−1).

In one or more embodiments, the input image data $D_{IN}$ associated with the four pixels Pin #(3$k$−1), Pin #(3$k$), Pin #(3$k$+1) and Pin #(3$k$+2) of the input image may be referred to as the input image data $D_{IN0}$, $D_{IN1}$, $D_{IN2}$ and $D_{IN3}$, respectively. The input image data $D_{IN0}$ describes the grayscale value $R_0$ of the R subpixel of the pixel Pin #(3$k$−1), the grayscale value $G_0$ of the G subpixel, and the grayscale value $B_0$ of the B subpixel, and the input image data $D_{IN1}$ describes the grayscale value $R_1$ of the R subpixel of the pixel Pin #(3$k$), the grayscale value $G_1$ of the G subpixel, and the grayscale value $B_1$ of the B subpixel. Similarly, the input image data $D_{IN2}$ describes the grayscale value $R_2$ of the R subpixel of the pixel Pin #(3$k$+1), the grayscale value $G_2$ of the G subpixel, and the grayscale value $B_2$ of the B subpixel, and the input image data $D_{IN3}$ describes the grayscale value $R_3$ of the R subpixel of the pixel Pin #(3$k$+2), the grayscale value $G_3$ of the G subpixel, and the grayscale value $B_3$ of the B subpixel. In the various embodiments, the grayscale value $R_i$ of the R subpixel described in the input image data $D_{INi}$, the grayscale value $G_i$ of the G subpixel and the grayscale value $B_i$ of the B subpixel may be referred to as input grayscale values $R_i$, $G_i$ and $B_i$, respectively, where i is an integer from zero to three.

In some embodiments, the output image data $D_{OUT}$ associated with two pixels Pout #(2$k$) and Pout #(2$k$+1) of the output image may be referred to as the output image data $D_{OUT0}$ and $D_{OUT1}$. The output image data $D_{OUT0}$ describes the grayscale value $NewR_0$ of the R subpixel of the pixel Pout #(2$k$) of the output image, the grayscale value $NewG_0$ of the G subpixel and the grayscale value $NewB_0$ of the B subpixel, and the output image data $D_{OUT1}$ describes the grayscale value $NewR_1$ of the R subpixel of pixel Pout #(2$k$+1) of the output image, the grayscale value $NewG_1$ of the G subpixel and the grayscale value $NewB_1$ of the B subpixel. In one or more embodiments, the grayscale value $NewR_j$ of the R subpixel described in the output image data $D_{OUTj}$, the grayscale value $NewG_j$ of the G subpixel and the grayscale value $NewB_j$ of the B subpixel may be referred to as output grayscale values $NewR_j$, $NewG_j$ and $NewB_j$, respectively, where j is zero or one.

Figure 4:
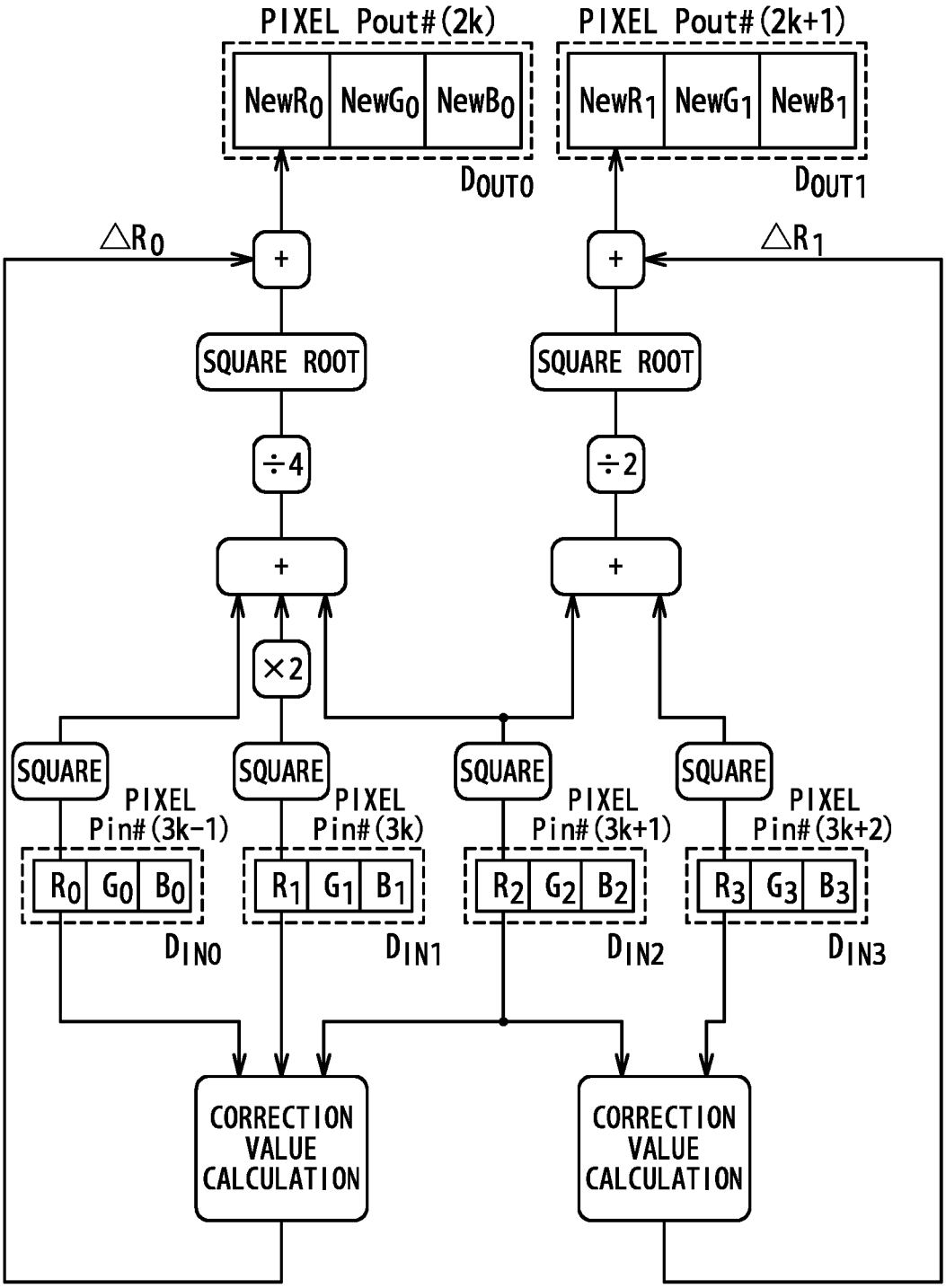
FIG. 4 is a conceptual diagram illustrating a method of calculating grayscale values according to one or more embodiments.

FIG. 4 schematically illustrates an example method of calculating the output grayscale values $NewR_0$ and $NewR_1$ (that is, the grayscale values $NewR_0$ and $NewR_1$ of the R subpixels of pixels Pout #(2$k$) and Pout #(2$k$+1) of the output image). The output grayscale values $NewR_0$ and $NewR_1$ are calculated as follows.

Input-side squared grayscale values $R_0^2$, $R_1^2$, $R_2^2$ and $R_3^2$, which are the squares of the input grayscale values $R_0$, $R_1$, $R_2$ and $R_3$, respectively (that is the grayscale values $R_0$, $R_1$, $R_2$ and $R_3$ of the R subpixels of pixels Pin #(3$k$−1), Pin #(3$k$), Pin #(3$k$+1) and Pin #(3$k$+2) of the input image) are calculated by the square calculation circuitry 21.

SPR-processed squared grayscale values $R_{SUB0}^2$ and $R_{SUB1}^2$ of the R subpixels of pixels Pout #(2$k$) and Pout #(2$k$+1) of the output image are further calculated from the input-side squared grayscale values $R_0^2$, $R_1^2$, $R_2^2$ and $R_3^2$ by the subpixel rendering calculation circuitry 22. The SPR-processed squared grayscale values $R_{SUB0}^2$ and $R_{SUB1}^2$ are calculated in accordance with the following expressions (1a) and (1b):

$$R_{SUB0}^2 = \frac{R_0^2 + 2 \times R_1^2 + R_2^2}{4} \tag{1a}$$

$$R_{SUB1}^2 = \frac{R_2^2 + R_3^2}{2} \tag{1b}$$

Furthermore, the square roots $R_{SUB0}$ and $R_{SUB1}$ of the SPR-processed squared grayscale values $R_{SUB0}^2$ and $R_{SUB1}^2$ of the R subpixels of pixels Pout #(2$k$) and Pout #(2$k$+1) of the output image are calculated by the square root calculation circuitry 23.

Further, in some embodiments, the correction value calculation circuitry 24 calculates correction values $\Delta R_0$ and $\Delta R_1$ for the respective R subpixels of pixels Pout #(2$k$) and Pout #(2$k$+1) of the output image in accordance with the following expressions (2a) and (2b):

$$\Delta R_0 = \frac{\left|\frac{R_0 + R_2}{2} - R_1\right|}{\alpha} \tag{2a}$$

$$\Delta R_1 = \frac{|R_2 - R_3|}{\alpha} \tag{2b}$$

The correction parameter α used in expressions (2a) and (2b) is stored in the register 16, and the correction value calculation circuitry 24 calculates the correction values $\Delta R_0$ and $\Delta R_1$ using the correction parameter α received from the register 16. The correction parameter α is calculated in accordance with the following expression (3a):

$$\alpha = \frac{\mathrm{MAX}}{\left\{\frac{\mathrm{MAX}^\gamma + 0^\gamma}{2}\right\}^{1/\gamma} - \left\{\frac{\mathrm{MAX}^2 + 0^2}{2}\right\}^{1/2}} \tag{3a}$$

where γ is the gamma value of the display panel 1 (the gamma value set to the display driver 2), and MAX is the allowed maximum value of the grayscale value of each subpixel of each pixel in the input image data $D_{IN}$ and the output image data $D_{OUT}$. In some embodiments, when both of the input image data $D_{IN}$ and the output image data $D_{OUT}$ describe the grayscale value of each subpixel of each pixel with eight bits, it holds:

$$\mathrm{MAX}=255(=2^8-1).$$

In this case, expression (3a) can be rewritten into the following expression (3b):

$$\alpha = \frac{255}{\left\{\frac{255^\gamma + 0^\gamma}{2}\right\}^{1/\gamma} - \left\{\frac{255^2 + 0^2}{2}\right\}^{1/2}} \tag{3b}$$

FIG. 5 is a table illustrating the correspondence between the gamma value γ and the correction parameter α calculated in accordance with the above-described expression (3b). The correction parameter α illustrated in FIG. 5 is calculated as a digital value of seven bits, and obtained by rounding a calculated in accordance with the expression (3b) into an integer. When the gamma value γ of the display panel 1 is 2.2, for example, the correction parameter α stored in the register 16 is set to 44.

The adder circuitry 25 calculates the output grayscale values $\mathrm{NewR}_0$ and $\mathrm{NewR}_1$ (that is, the grayscale values $\mathrm{NewR}_0$ and $\mathrm{NewR}_1$ of the R subpixels of pixels Pout #(2$k$) and Pout #(2$k$+1)) by adding the correction values $\Delta R_0$ and $\Delta R_1$ to the square roots $R_{SUB0}$ and $R_{SUB1}$ calculated for the R subpixels of pixels Pout #(2$k$) and Pout #(2$k$+1) of the output image, respectively. In other words, the adder circuitry 25 calculates the output grayscale values $\mathrm{NewR}_0$ and $\mathrm{NewR}_1$ in accordance with the following expressions (4a) and (4b):

$$NewR_0 = R_{SUB0} + \Delta R_0, \text{ and} \tag{4a}$$

$$NewR_1 = R_{SUB1} + \alpha R_1 \tag{4b}$$

According to the calculation described above, the output grayscale values $\mathrm{NewR}_0$ and $\mathrm{NewR}_1$ are resultantly calculated in accordance with the following expressions (5a) and (5b), as a whole of the subpixel rendering circuitry 20:

$$NewR_0 = \sqrt[2]{\frac{R_0^2 + 2 \times R_1^2 + R_2^2}{4}} + \frac{\left|\frac{R_0 + R_2}{2} - R_1\right|}{\alpha} \tag{5a}$$

$$NewR_1 = \sqrt[2]{\frac{R_2^2 + R_3^2}{2}} + \frac{|R_2 - R_3|}{\alpha} \tag{5b}$$

In various embodiments, the calculation of the output grayscale values $\mathrm{NewR}_0$ and $\mathrm{NewR}_1$ in accordance with expressions (5a) and (5b) allows obtaining grayscale values approximate to those obtained by strictly performing a subpixel rendering process based on gamma conversion and inverse gamma conversion.

In one or more embodiments, when a subpixel rendering process is strictly performed using gamma conversion and inverse gamma conversion, the output grayscale value $\mathrm{NewR}_0$ and $\mathrm{NewR}_1$ of the R subpixels of pixels Pout #(2$k$) and Pout #(2$k$+1) of the output image are calculated in accordance with the following expressions (6a) and (6b):

$$NewR_0 = \sqrt[\gamma]{\frac{R_0^\gamma + 2 \times R_1^\gamma + R_2^\gamma}{4}} \tag{6a}$$

$$NewR_1 = \sqrt[\gamma]{\frac{R_2^\gamma + R_3^\gamma}{2}} \tag{6b}$$

When γ is approximately equal to two, the following approximation expressions (7a) and (7b) hold:

$$\sqrt[\gamma]{\frac{A^\gamma + 2\times B^\gamma + C^\gamma}{4}} \approx \sqrt[2]{\frac{A^2 + 2\times B^2 + C^2}{4}} + \frac{\left|\frac{A+C}{2} - C\right|}{\alpha} \tag{7a}$$

$$\sqrt[\gamma]{\frac{C^\gamma + D^\gamma}{2}} \approx \sqrt[2]{\frac{C^2 + D^2}{2}} + \frac{|C-D|}{\alpha} \tag{7b}$$

The right sides of expressions (5a) and (5b) can be obtained by substituting $R_0$, $R_1$, $R_2$ and $R_3$ into A, B, C and D of the right sides of expressions (7a) and (7b), respectively. This implies that an approximation can be achieved with a sufficient accuracy by calculating the output grayscale value $NewR_0$ and $NewR_1$ in accordance with expressions (5a) and (5b). According to an inventors' study, for a gamma value $\gamma$ from 2.0 to 3.0, a sufficient accuracy can be achieved by calculating the output grayscale values $NewR_0$ and $NewR_1$ with a correction parameter $\alpha$ of seven bits in accordance with expressions (5a) and (5b).

Expressions 8a and 8b illustrate a calculation example for the case where the gamma value $\gamma$ of the display panel 1 is 2.2. When the gamma value $\gamma$ is 2.2, the correction parameter $\alpha$ is set to "44" as understood from FIG. 5. When the input grayscale values $R_0$, $R_1$, $R_2$ and $R_3$ are "255", "255" and "0", respectively, the output grayscale values $NewR_0$ and $NewR_1$ are calculated as follows:

$$\begin{aligned} NewR_0 &= \sqrt[2]{\frac{255^2 + 2\times 0^2 + 255^2}{4}} + \frac{\left|\frac{255+255}{2} - 0\right|}{44} \\ &= 180.0 + 6.0 \\ &= 186.0 \end{aligned} \tag{8a}$$

$$\begin{aligned} NewR_1 &= \sqrt[2]{\frac{0^2 + 255^2}{2}} + \frac{|0-255|}{44} \\ &= 180.0 + 6.0 \\ &= 186.0 \end{aligned} \tag{8b}$$

The calculated output grayscale values $NewR_0$ and $NewR_1$ are equal to the values obtained by strictly performing the subpixel rendering process with gamma conversion and inverse gamma conversion.

When the gamma value $\gamma$ is 2.0, the correction parameter $\alpha$ calculated in accordance with expression (3a) or (3b) is infinite. In this case, in one embodiment, the correction values $\Delta R_0$ and $\Delta R_1$ may be calculated as zero by the correction value calculation circuitry 24. To achieve such operation, the display driver 2 may be configured such that a flag which is asserted when the gamma value $\gamma$ is 2.0 is prepared in the register 16 and the correction value calculation circuitry 24 is configured to unconditionally set the correction values $\Delta R_0$ and $\Delta R_1$ to zero when the flag is asserted.

The grayscale values $NewG_0$ and $NewG_1$ of the G subpixels of pixels Pout #(2*k*) and Pout #(2*k*+1) of the output image and the grayscale values $NewB_0$ and $NewB_1$ of the B subpixels are calculated in a similar way.

In one embodiment, input-side squared grayscale values $G_0^2$, $G_1^2$, $G_2^2$ and $G_3^2$, which are squares of the grayscale values $G_0$, $G_1$, $G_2$ and $G_3$ of the G subpixels of pixels Pin #(3*k*−1), Pin #(3*k*), Pin #(3*k*+1) and Pin #(3*k*+2) of the input image, and input-side squared grayscale values $B_0^2$, $B_1^2$, $B_2^2$ and $B_3^2$, which are squares of the grayscale values $B_0$, $B_1$, $B_2$ and $B_3$ of the B subpixels, are calculated by the square calculation circuitry 21.

SPR-processed squared grayscale values $G_{SUB0}^2$ and $G_{SUB1}^2$ of the G subpixels of pixels Pout #(2*k*) and Pout #(2*k*+1) of the output image are further calculated from the input-side squared grayscale values $G_0^2$, $G_1^2$, $G_2^2$ and $G_3^2$ by the subpixel rendering calculation circuitry 22, and SPR-processed squared grayscale values $B_{SUB0}^2$ and $B_{SUB1}^2$ of the B subpixels are calculated from the input-side squared grayscale values $B_0^2$, $B_1^2$, $B_2^2$ and $B_3^2$. The SPR-processed squared grayscale values $G_{SUB0}^2$, $G_{SUB1}^2$, $B_{SUB0}^2$ and $B_{SUB1}^2$ are calculated in accordance with the following expressions (9a), (9b), (10a) and (10b):

$$G_{SUB0}^2 = \frac{G_0^2 + 2\times G_1^2 + G_2^2}{4} \tag{9a}$$

$$G_{SUB1}^2 = \frac{G_2^2 + G_3^2}{2} \tag{9b}$$

$$B_{SUB0}^2 = \frac{B_0^2 + 2\times B_1^2 + B_2^2}{4} \tag{10a}$$

$$B_{SUB1}^2 = \frac{B_2^2 + B_3^2}{2} \tag{10b}$$

Furthermore, the square roots $G_{SUB0}$ and $G_{SUB1}$ of the SPR-processed squared grayscale values $G_{SUB0}^2$ and $G_{SUB1}^2$ of the G subpixels of pixels Pout #(2*k*) and Pout #(2*k*+1) of the output image and the square roots $B_{SUB0}$ and $B_{SUB1}$ of the SPR-processed squared grayscale values $B_{SUB0}^2$ and $B_{SUB1}^2$ of the B subpixels are calculated by the square root calculation circuitry 23.

Further, in some embodiments, the correction value calculation circuitry 24 calculates correction values $\Delta G_0$ and $\Delta G_1$ for the respective G subpixels of pixels Pout #(2*k*) and Pout #(2*k*+1) of the output image in accordance with the following expressions (11a) and (11b) and calculates correction values $\Delta B_0$ and $\Delta B_1$ for the respective B subpixels in accordance with the following expressions (12a) and (12b):

$$\Delta G_0 = \frac{\left|\frac{G_0 + G_2}{2} - G_1\right|}{\alpha} \tag{11a}$$

$$\Delta G_1 = \frac{|G_2 - G_3|}{\alpha} \tag{11b}$$

$$\Delta B_0 = \frac{\left|\frac{B_0 + B_2}{2} - B_1\right|}{\alpha} \tag{12a}$$

$$\Delta B_1 = \frac{|B_2 - B_3|}{\alpha} \tag{12b}$$

The adder circuitry 25 calculates the grayscale values $NewG_0$ and $NewG_1$ of the G subpixels of pixels Pout #(2*k*) and Pout #(2*k*+1) of the output image by adding the correction values $\Delta G_0$ and $\Delta G_1$ to the square roots $G_{SUB0}$ and $G_{SUB1}$ calculated for the G subpixels of pixels Pout #(2*k*) and Pout(2*k*+1) of the output image, respectively. Similarly, the adder circuitry 25 also calculates the grayscale values $NewB_0$ and $NewB_1$ of the B subpixels of pixels Pout #(2*k*) and Pout #(2*k*+1) of the output image by adding the correction values $\Delta B_0$ and $\Delta B_1$ to the square roots $B_{SUB0}$ and $B_{SUB1}$ calculated for the B subpixels of pixels Pout #(2*k*) and Pout #(2*k*+1) of the output image, respectively.

In other words, the adder circuitry 25 calculates the grayscale values $NewG_0$ and $NewG_1$ of the G subpixels of pixels Pout #(2*k*) and Pout #(2*k*+1) of the output image and the grayscale values $NewB_0$ and $NewB_1$ of the B subpixels in accordance with the following expressions (13a), (13b) (14a) and (14b):

$$NewG_0=G_{SUB0}+\Delta G_0 \quad ,(13a)$$

$$NewG_1=G_{SUB1}+\Delta G_1 \quad ,(13b)$$

$$NewB_0=B_{SUB0}+\Delta B_0, \text{ and} \quad (14a)$$

$$NewB_1=B_{SUB1}+\Delta B_1 \quad ,(14b)$$

According to the calculation described above, the grayscale values $NewG_0$ and $NewG_1$ of the G subpixels of pixels Pout #(2*k*) and Pout #(2*k*+1) of the output image and the grayscale values $NewB_0$ and $NewB_1$ of the B subpixels are resultantly calculated in accordance with the following expressions (15a), (15b), (16a) and (16b), as a whole of the subpixel rendering circuitry 20:

$$NewG_0=\sqrt[2]{\frac{G_0^2+2\times G_1^2+G_2^2}{4}}+\frac{\left|\frac{G_0+G_2}{2}-G_1\right|}{\alpha} \quad (15a)$$

$$NewG_1=\sqrt[2]{\frac{G_2^2+G_3^2}{2}}+\frac{|G_2-G_3|}{\alpha} \quad (15b)$$

$$NewB_0=\sqrt[2]{\frac{B_0^2+2\times B_1^2+B_2^2}{4}}+\frac{\left|\frac{B_0+B_2}{2}-B_1\right|}{\alpha} \quad (16a)$$

$$NewB_1=\sqrt[2]{\frac{B_2^2+B_3^2}{2}}+\frac{|B_2-B_3|}{\alpha} \quad (16b)$$

In various embodiments, the calculation of the grayscale values $NewG_0$ and $NewG_1$ of the G subpixels of pixels Pout #(2*k*) and Pout #(2*k*+1) and the grayscale values $NewB_0$ and $NewB_1$ of the B subpixels in accordance with expressions (15a), (15b), and (16a) and (16b) achieves a sufficiently accurate approximation.

As described above, the subpixel rendering circuitry 20 of this embodiment is configured to perform square calculation in place of gamma conversion and perform square root calculation in place of inverse gamma conversion, while compensating the error caused by such operation by adding a correction value. Such configuration of the subpixel rendering circuitry 20 of this embodiment effectively reduces the circuit size thereof.

In one embodiment, the subpixel rendering circuitry 20 of this embodiment also offers an advantage that the gamma value $\gamma$ can be easily modified by modifying the correction parameter $\alpha$ stored in the register 16. When the register 16 can be rewritten from the host 3, the host 3 may access the register 16 to modify the correction parameter $\alpha$ stored in the register 16. For example, as is understood from FIG. 5, the gamma value $\gamma$ used in the subpixel rendering circuitry 20 can be modified from 2.2 to 2.1 by accessing the register 16 from the host 3 and modifying the correction parameter $\alpha$ stored in the register 16 from 44 to 85.

Although the above-described embodiment recites the configuration in which output image data $D_{OUT}$ associated with two pixels of the output image are calculated from input image data $D_{IN}$ associated with four pixels of the input image, a subpixel rendering process may be generally achieved in a similar procedure also for the case where output image data $D_{OUT}$ associated with M pixels of the output image are calculated from input image data $D_{IN}$ associated with N pixels of the input image, for N being an integer two or more, and M being an integer satisfying $1 \leq M < N$.

Figure 6:
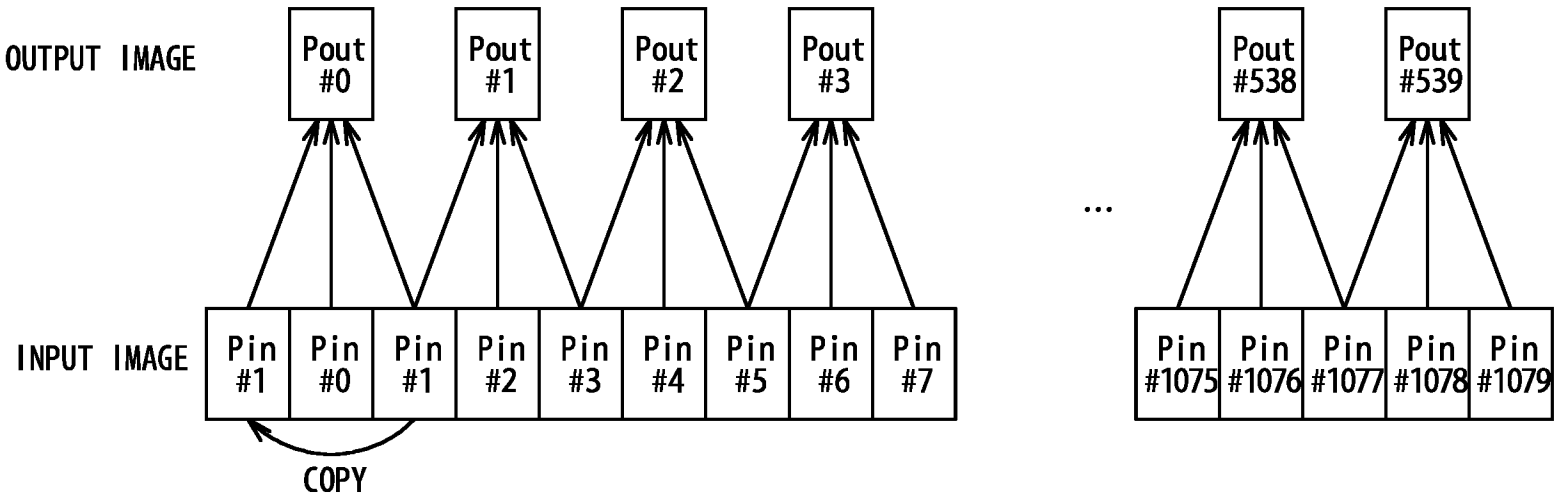
FIG. 6 is a conceptual diagram illustrating the correspondence relationship between pixels according to one or more embodiments.

FIG. 6 schematically illustrates the correspondence relationship between the pixels of the input image and those of the output image in a subpixel rendering process for the case where the ratio of the number of the pixels of the input image to that of the output image is 2:1. Illustrated in FIG. 6 is an example in which output image data $D_{OUT}$ associated with 540 pixels arrayed in the horizontal direction are calculated from the input image data $D_{IN}$ associated with 1080 pixels arrayed in the horizontal direction.

In the subpixel rendering process illustrated in FIG. 6, an output image data $D_{OUT}$ associated with one pixel of the output image is calculated from input image data $D_{IN}$ associated with three pixels of the input image. In one embodiment, the output image data $D_{OUT}$ associated with pixel Pout #k of the output image is calculated from the input image data $D_{IN}$ associated with pixels Pin #(2*k*−1), Pin #(2*k*) and Pin(2*k*+1) of the input image, where k is an integer equal to or more than zero.

For the case where k is zero, that is, for the calculation of the output image data $D_{OUT}$ associated with the leftmost pixel Pout #0 of the output image, pixel Pin #0 of the input image is positioned leftmost in the horizontal direction and pixel Pin #(−1) does not exist. In various embodiments, to address this, the output image data $D_{OUT}$ associated with pixel Pout #0 of the output image is calculated by using the input image data $D_{IN}$ associated with pixel Pin #1, in place of the input image data $D_{IN}$ associated with pixel Pin #(−1). In other words, the output image data $D_{OUT}$ associated with pixel Pout #0 of the output image is calculated from the input image data $D_{IN}$ associated with pixels Pin #1, Pin #0 and Pin #1 of the input image. Also in this case, the output image data $D_{OUT}$ associated with pixel Pout #0 of the output image can be virtually considered as being calculated from the input image data $D_{IN}$ associated with three pixels Pin #1, Pin #0 and Pin #1 of the input image.

Figure 7:
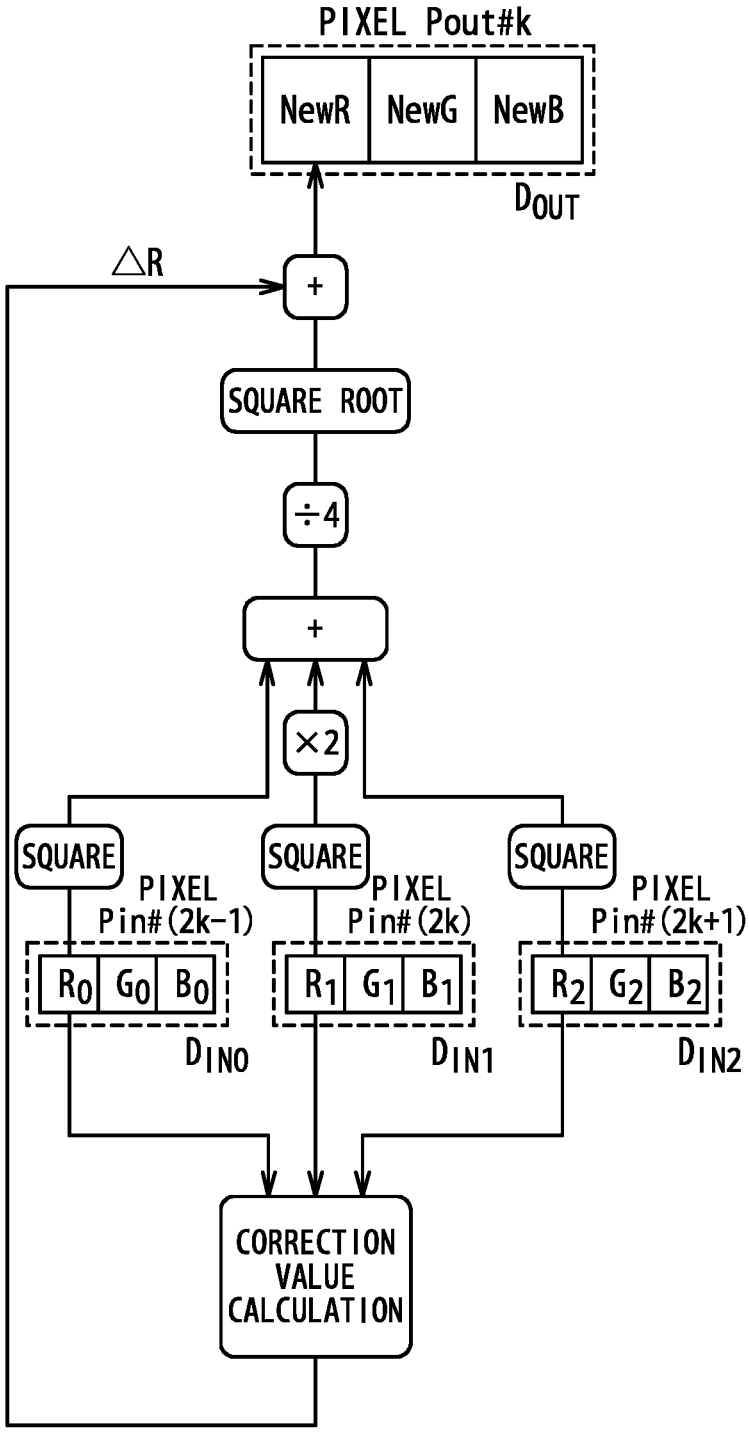
FIG. 7 is a conceptual diagram illustrating a method of calculating grayscale values according to one or more embodiments.

FIG. 7 schematically illustrates the method of calculating the grayscale values NewR of the R subpixel of pixels Pout #k of the output image (the output grayscale value NewR). The output grayscale value NewR may be calculated as follows.

Input-side squared grayscale values $R_0^2$, $R_1^2$ and $R_2^2$, which are the squares of the grayscale values $R_0$, $R_1$ and $R_2$ of the R subpixels of pixels Pin #(2*k*−1), Pin #(2*k*) and Pin #(2*k*+1) of the input image (the input grayscale values $R_0$, $R_1$ and $R_2$) are calculated by the square calculation circuitry 21.

An SPR-processed squared grayscale values $R_{SUB}^2$ of the R subpixel of pixel Pout #k of the output image is then calculated from the input-side squared grayscale values $R_0^2$, $R_1^2$ and $R_2^2$ by the subpixel rendering calculation circuitry 22. The SPR-processed squared grayscale values $R_{SUB}^2$ is calculated in accordance with the following expression (17):

$$R_{SUB}^2=\frac{R_0^2+2\times R_1^2+R_2^2}{4} \quad (17)$$

Furthermore, the square root $R_{SUB}$ of the SPR-processed squared grayscale values $R_{SUB}^2$ of the R subpixel of pixel Pout #k of the output image is calculated by the square root calculation circuitry 23.

Meanwhile, the correction value calculation circuitry 24 calculates a correction value ΔR in accordance with the following expression (18):

$$\Delta R = \frac{\left|\frac{R_0 + R_2}{2} - R_1\right|}{\alpha} \tag{18}$$

The correction parameter α in expression (18) is stored in the register 16, and the correction value calculation circuitry 24 calculates the correction value ΔR using the correction parameter α received from the register 16.

The adder circuitry 25 calculates the output grayscale value NewR (that is, the grayscale value NewR of the R subpixel of pixel Pout #k) by adding the correction values ΔR to the square root $R_{SUB}$ calculated for the R subpixel of pixel Pout #k of the output image. In other words, the adder circuitry 25 calculates the output grayscale value NewR in accordance with the following expressions (19):

$$NewR = R_{SUB} + \Delta R. \tag{19}$$

According to the calculation described above, the output grayscale value NewR is resultantly calculated in accordance with the following expression (20), as a whole of the subpixel rendering circuitry 20:

$$NewR = \sqrt[2]{\frac{R_0^2 + 2 \times R_1^2 + R_2^2}{4}} + \frac{\left|\frac{R_0 + R_2}{2} - R_1\right|}{\alpha} \tag{20}$$

The grayscale value NewG of the G subpixel of pixel Pout #k and the grayscale value NewB of the B subpixel are calculated in a similar way. It would be easily understood by a person skilled in the art from the above-described discussion that the calculation of the grayscale value NewR of the R subpixel of pixel Pout #k, the grayscale value NewG of the G subpixel and the grayscale value NewB of the B subpixel in this way achieves a sufficiently accurate approximation.

Figure 8:
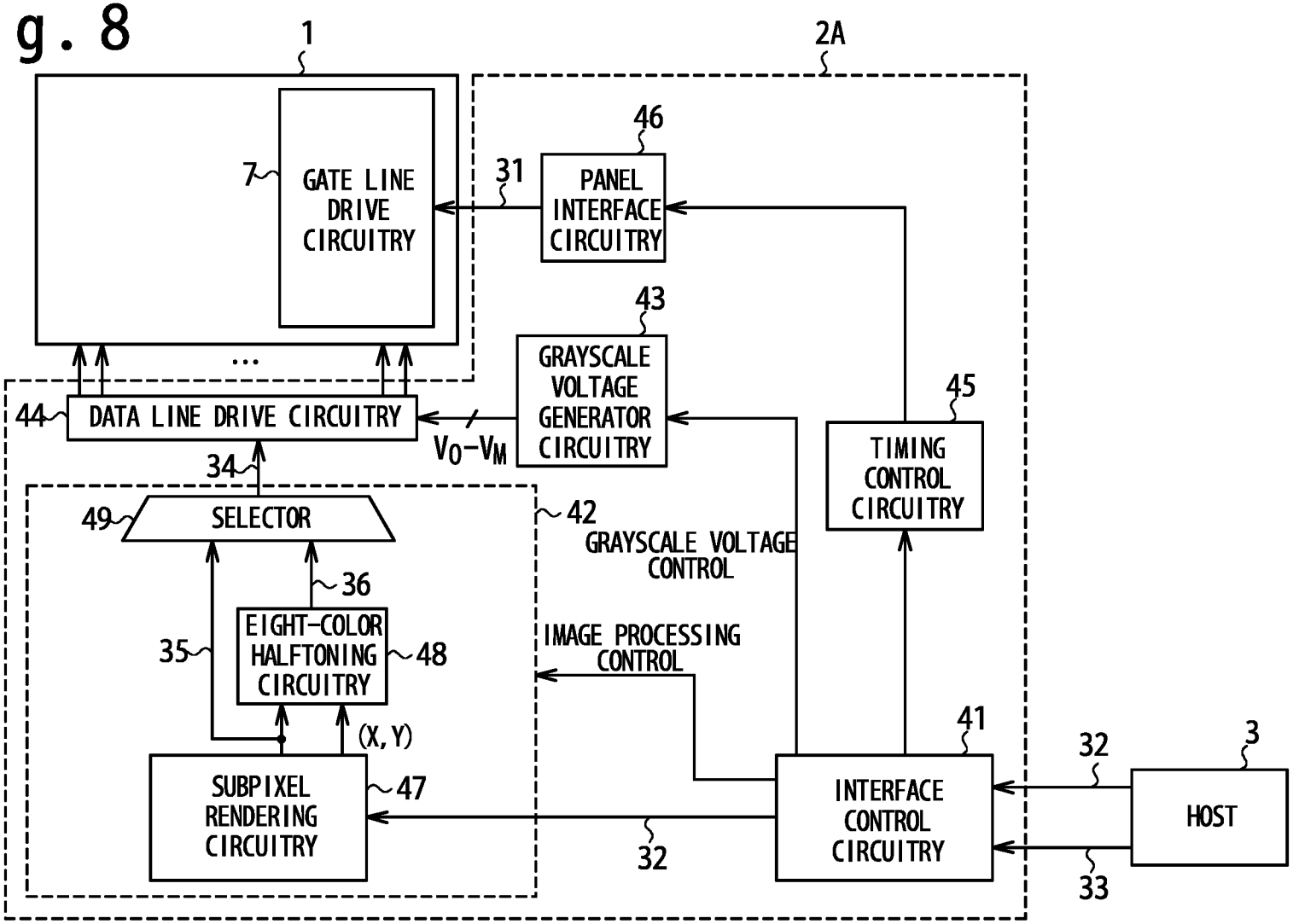
FIG. 8 is a block diagram illustrating the configuration of a display driver according to one or more embodiments.

In one embodiment, as illustrated in FIG. 8, a display driver 2A may be configured to perform an eight-color halftoning process as well as a subpixel rendering process. The "eight-color halftoning process" referred herein is a process of converting image data associated with an original image into image data in which the number of allowed colors of each pixel is eight, that is, the number of the allowed grayscale levels of each of the R, G and B subpixel of each pixel is two. When an eight-color halftoning process is performed on image data associated with a specific pixel, the resultant image data is generated as three-bit data which specifies "turn-on" or "turn-off" of each of the R, G and B subpixel of the pixel. Here, the "turn-on" of a subpixel means driving the subpixel with a grayscale voltage corresponding to the allowed maximum grayscale value, and the "turn-off" of a subpixel means driving the subpixel with a grayscale voltage corresponding to the allowed minimum grayscale value.

As illustrated, the display driver 2A includes an interface control circuitry 41, an image processing circuitry 42, a grayscale voltage generator circuitry 43, a data line drive circuitry 44, a timing control circuitry 45 and a panel interface circuitry 46.

In various embodiments, the interface control circuitry 41 forwards the image data 32 received from the host 3 to the image processing circuitry 42. Additionally, the interface control circuitry 41 controls the respective circuitries of the display driver 2 in response to control parameters and commands included in the control data 33. The image processing circuitry 42 generates display data 34 used to drive the display panel 1 by performing image data processing on the image data 32 received from the interface control circuitry 41. The grayscale voltage generator circuitry 43 generates a set of grayscale voltages $V_0$ to $V_M$ respectively corresponding to the allowed values of the grayscale values described in the display data 34. The data line drive circuitry 44 drives the respective data lines 5 with the grayscale voltages corresponding to the grayscale values described in the display data 34. In one embodiment, the data line drive circuitry 44 selects the grayscale voltages corresponding to the grayscale values described in the display data 34 for the respective data lines 5, from among the grayscale voltages $V_0$ to $V_M$ received from the grayscale voltage generator circuitry 43, and drives the respective data lines 5 to the selected grayscale voltages. The timing control circuitry 45 performs timing control of the respective circuitries of the display driver 2 in response to control signals received from the interface control circuitry 41. The panel interface circuitry 46 supplies the gate control signals 31 to the gate line drive circuitries 7 of the display panel 1 to thereby control the gate line drive circuitries 7.

In this embodiment, the grayscale voltage generator circuitry 43 is configured to stop generating the grayscale voltages corresponding to intermediate grayscale values (that is, the grayscale voltages other than the grayscale voltages corresponding to the allowed maximum and minimum grayscale values). Out of the grayscale voltages $V_0$ to $V_M$, the grayscale voltage $V_0$ corresponds to the allowed minimum grayscale value and the grayscale voltage $V_M$ corresponds to the allowed maximum grayscale value. Accordingly, the grayscale voltages $V_1$ to $V_{M-1}$ respectively correspond to the intermediate grayscale values. In response to an instruction by the grayscale voltage control signals supplied from the interface control circuitry 41, the grayscale voltage generator circuitry 43 stops generating the grayscale voltages $V_1$ to $V_{M-1}$, which correspond to the intermediate grayscale values.

In one or more embodiments, the gamma characteristics of the data line drive circuitry 44 depend on the distribution of the voltage levels of the grayscale voltages $V_0$ to $V_M$ supplied from the grayscale voltage generator circuitry 43. To set the data line drive circuitry 44 to desired gamma characteristics, the distribution of the voltage levels of the grayscale voltages $V_0$ to $V_M$ is determined in accordance with the desired gamma characteristics. The grayscale voltages $V_0$ to $V_M$ generated by the grayscale voltage generator circuitry 43 are controlled by grayscale voltage control signals supplied from the interface control circuitry 41.

The gamma characteristics of the entire display driver 2 are determined as a superposition of the gamma characteristics of the image processing performed in the image processing circuitry 42 and the gamma characteristics of the data line drive circuitry 44. To display an image with appropriate brightness, the gamma characteristics of the entire display driver 2 may be set to match the gamma characteristics of the display panel 1.

In this embodiment, the image processing circuitry 42 is configured to perform a subpixel rendering process and an eight-color halftoning process. More specifically, the image processing circuitry 42 includes a subpixel rendering circuitry 47, an eight-color halftoning circuitry 48 and a selector 49 in this embodiment.

The subpixel rendering circuitry 47 performs a subpixel rendering process on the image data 32 received from the interface control circuitry 41 to generate SPR-processed image data 35 and supplies the generated SPR-processed image data 35 to the eight-color halftoning circuitry 48 and the selector 49. Hereinafter, the image corresponding to the SPR-processed image data may be referred to as SPR-processed image. The subpixel rendering circuitry 47 also supplies the address indicating the position of each pixel in the SPR-processed image to the eight-color halftoning circuitry 48. When supplying an SPR-processed image data 35 associated with a certain pixel to the eight-color halftoning circuitry 48, the subpixel rendering circuitry 47 supplies the address of the pixel to the eight-color halftoning circuitry 48 in synchronization with the supply of this SPR-processed image data 35.

In one embodiment, the subpixel rendering circuitry 47 may be configured similarly to the subpixel rendering circuitry 20 illustrated in FIG. 2. In this case, the subpixel rendering circuitry 47 may perform the subpixel rendering process as described above. In an alternative embodiment, the subpixel rendering circuitry 47 may perform a different subpixel rendering process.

The eight-color halftoning circuitry 48 generates binary image data 36 by performing an eight-color halftoning process on the SPR-processed image data 35.

The selector 49 selects one of the SPR-processed image data 35 received from the subpixel rendering circuitry 47 and the binary image data 36 received from the eight-color halftoning circuitry 48, and supplies the selected image data to the data line drive circuitry 44 as the display data 34. The data line drive circuitry 44 drives the display panel 1 in response to the display data 34 received from the selector 49.

In one or more embodiments, when causing the image processing circuitry 42 to perform the eight-color halftoning process, the interface control circuitry 41 supplies an image processing control signal to the image processing circuitry 42 to instruct to perform the eight-color halftoning process. The selector 49 selects the binary image data 36 in response to the image processing control signal. Additionally, the interface control circuitry 41 supplies the grayscale voltage control signals to the grayscale voltage generator circuitry 43 to instruct to stop generating the grayscale voltages $V_1$ to $V_{M-1}$, which correspond to the intermediate grayscale values. The grayscale voltage generator circuitry 43 stops generating the grayscale voltages $V_1$ to $V_{M-1}$, which correspond to the intermediate grayscale values, in response to the grayscale voltage control signals. This allows reducing the power consumption of the grayscale voltage generator circuitry 43. Note that, in some embodiments, the generation of the grayscale voltages $V_0$ and $V_M$, which correspond to the allowed minimum and maximum grayscale values, respectively, is continued even when the generation of the grayscale voltages $V_1$ to $V_{M-1}$, which correspond to the intermediate grayscale values, is stopped.

Although FIG. 8 illustrates the configuration in which the subpixel rendering circuitry 47 performs the subpixel rendering process on the image data 32 received from the interface control circuitry 41, the subpixel rendering circuitry 47 may perform the subpixel rendering process on image data generated by performing desired image data processing on the image data 32. Although FIG. 8 illustrates the configuration in which the SPR-processed image data 35 output from the subpixel rendering circuitry 47 are supplied to the selector 49, image data generated by performing desired image data processing on the SPR-processed image data 35 may be supplied to the selector 49 in place of the SPR-processed image data 35.

In some embodiments, to achieve an eight-color halftoning process on multi-grayscale-level image data may be to determine whether each subpixel is to be "turned-on" or "turned off", depending on the most significant bit of data indicating the grayscale value of the subpixel; note that the SPR-processed image data 35 are a sort of multi-grayscale-level image data. By "turning on" each subpixel of the pixel of interest when the most significant bit of the data indicating the grayscale value of the subpixel is "1" and "turning off" each subpixel when the most significant bit of the data indicating the grayscale value of the subpixel is "0", it is possible to display an image in which the number of the allowed colors of each pixel is eight. This eight-color halftoning process, however, largely deteriorates the image quality, because spatial changes in the grayscale values in the image cannot be sufficiently represented.

The eight-color halftoning process can be considered as a color reduction process which reduces an increased number of bits. Therefore, a dithering process, which is known as one of color reduction processes which effectively suppress image quality deterioration, may be a potential eight-color halftoning process. Performing a dithering process allows representing spatial changes in the grayscale values in the image and thereby reducing image quality deterioration. In some embodiments, a dithering process is achieved by adding a dither value determined in a random manner to image data and then truncating one or more lower bits. The term "random" referred herein means that the probabilities in which the dither value takes the respective allowed values are the same. For example, an eight-color halftoning process with respect to image data which represents the grayscale value of each subpixel with eight bits can be achieved by adding an eight-bit dither value to the image data of each subpixel (note that the resultant value is nine bits), and extracting the most significant bit (that is, truncating the lower eight bits).

In various embodiments, generation of a dither value used in the dithering process is achieved by reading out a dither value from a dither table describing allowed dither values as elements, in response to the address of the pixel of interest. FIG. 9 illustrates one example of a dither table which includes 16×16 elements and describes eight-bit dither values as the respective elements. The dither table illustrated in FIG. 9 includes 256 elements and the dither values described in the respective elements are set to different values from zero to 255. In other words, the dither table illustrated in FIG. 9 is determined so that the number of elements taking each of the values from zero to 255 is one. For example, a random dither value can be generated by selecting a dither value from the 256 elements of the dither table illustrated in FIG. 9 in response to the lower four bits of the X address and the lower four bits of the Y address, where the X address is the address indicating the position in the horizontal direction of the display panel 1 (the direction in which the gate lines are extended), and the Y address is the address indicating the position in the vertical direction (the direction in which the data lines are extended).

It should be noted that the setting of the gamma characteristics of the data line drive circuitry 44 with the distribution of the voltage levels of the grayscale voltages $V_0$ to $V_M$ the does not work when an image is displayed in response to image data obtained through an eight-color halftoning process, because the displayed image only includes subpixels of the allowed maximum grayscale value and the allowed minimum value. When the eight-color halftoning process is performed, the grayscale voltages $V_1$ to $V_{M-1}$, which correspond to intermediate grayscale values, are not used and therefore the setting of the grayscale voltages $V_1$ to $V_{M-1}$ does not have any effects on the gamma characteristics of the data line drive circuitry 44.

Figure 10:
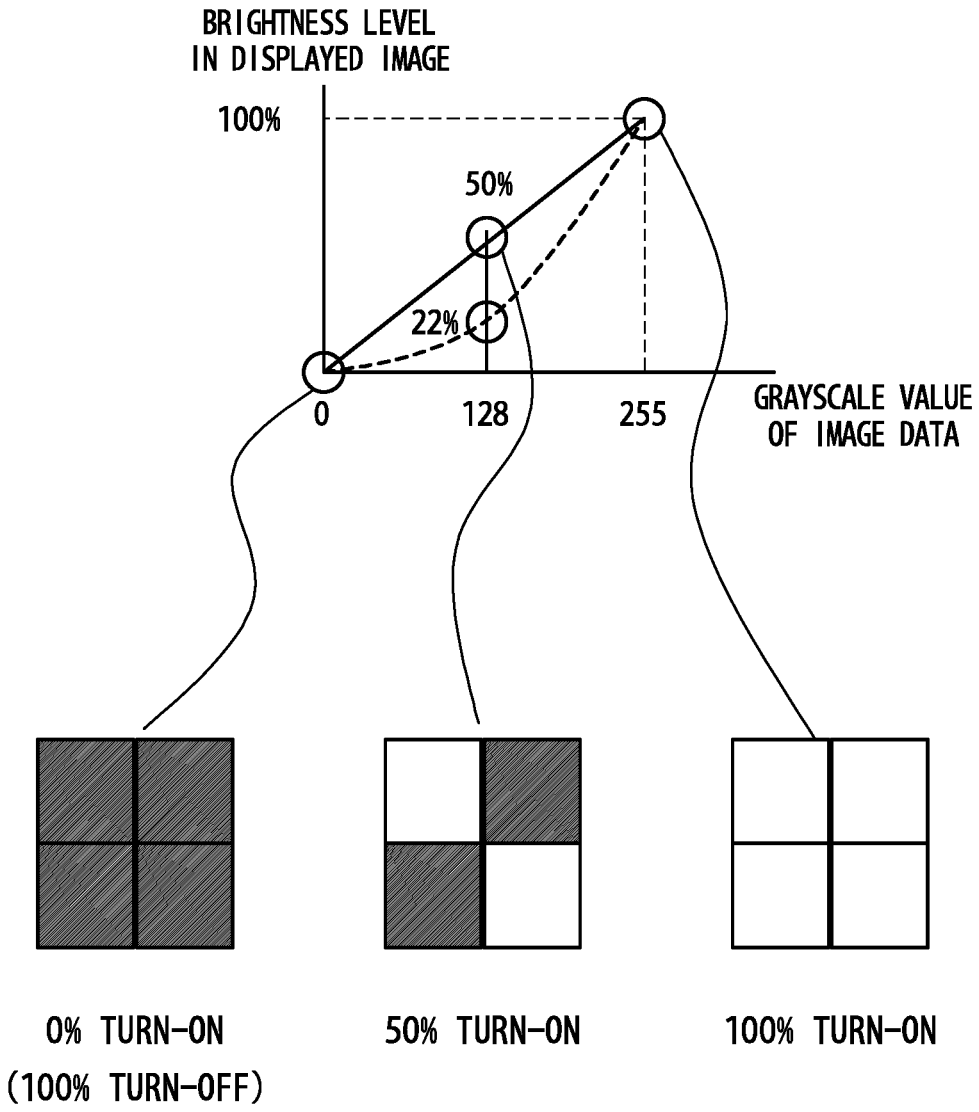
FIG. 10 illustrates the gamma characteristics of a dithering process according to one or more embodiments.

It should be also noted that, when an eight-color halftoning process is achieved through a dithering process with a dither value determined in a random way, such eight-color halftoning process is equivalent to image processing of a gamma value γ of one. FIG. 10 illustrates the gamma characteristics of an eight-color halftoning process achieved through a dithering process with a dither value determined in a random way, where the grayscale value of each subpixel is represented with an eight bit value (from zero to 255). In FIG. 10, the solid line indicates the gamma characteristics of the eight-color halftoning process achieved through the dithering process with a dither value determined in a random way and the broken line indicates the gamma characteristics of a gamma value of 2.2.

When a dither processing is performed on image data associated with a certain subpixel with a dither value determined in a random manner, the probability in which the subpixel is "turned on" increases in proportion to the grayscale value specified by the image data associated with the subpixel. When the grayscale value specified for a certain subpixel is "0", the probability in which the subpixel is "turned on" is 0%, and, when the grayscale value is "255", the probability is 100%. For a grayscale value of "128", the subpixel is "turned off" when the dither value is zero to 127, and "turned on" when the dither value is 128 to 255. In other words, for a grayscale value of "128", the subpixel is "turned on" with a probability of 50% and "turned off" with a probability of 50%. Accordingly, the effective brightness level of the subpixel in the displayed image is 50% of the allowed maximum brightness level. As thus discussed, the probability in which a subpixel is "turned on" increases in proportion to the grayscale value specified for the subpixel and the effective brightness level of the subpixel in the displayed image also increases in proportion to the grayscale value specified for the subpixel. This implies that the gamma value of the dithering process with a dither value determined in a random way is one.

Accordingly, the eight-color halftoning process achieved through a dithering process with a dither value determined in a random way may cause mismatching of the gamma characteristics of the entire display driver 2 and those of the display panel 1, and results in that the brightness level of each subpixel may not be appropriately represented in the displayed image, although the eight-color halftoning process can represent spatial changes in the grayscale values in the displayed image.

The eight-color halftoning circuitry 48 of this embodiment is configured to perform an eight-color halftoning process based on a dithering process, while addressing this problem. In the following, a description is given of the configuration and operation of the eight-color halftoning circuitry 48 in this embodiment.

Figure 11:
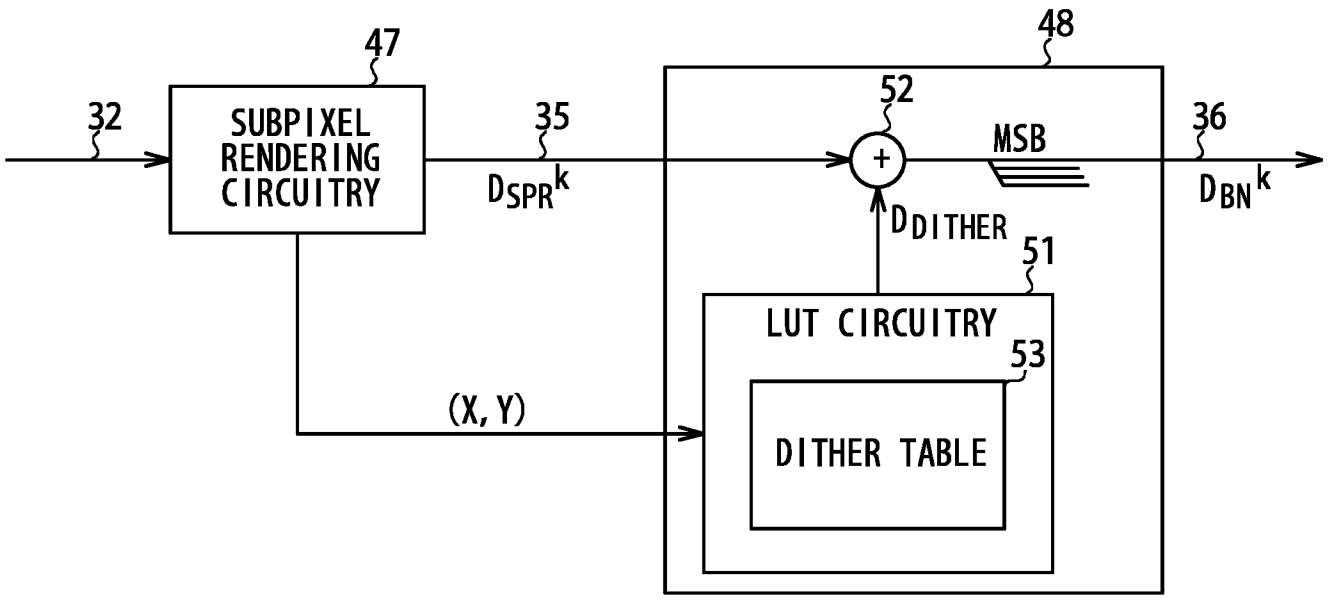
FIG. 11 is a block diagram illustrating the configuration of an eight-color halftoning circuitry according to one or more embodiments.

FIG. 11 is a block diagram illustrating the eight-color halftoning circuitry 48. In this embodiment, the eight-color halftoning circuitry 48, which is configured to perform a dithering process with a dither value, includes an LUT (lookup table) circuitry 51 and an adder circuitry 52.

The LUT circuitry 51 is a storage circuitry storing a dither table 53. The LUT circuitry 51 selects a dither value $D_{DITHER}$ from the elements of the dither table 53 in response to the X address and Y address of the pixel of interest supplied from the subpixel rendering circuitry 47 and supplies the selected dither value $D_{DITHER}$ to the adder circuitry 52. In FIG. 11, the X address and Y address are indicated by the legend "(X, Y)". Here, the X address of the pixel of interest indicates the position in the horizontal direction (the direction corresponding to the direction in which the gate lines are extended in the display panel 1) in the SPR-processed image (the image corresponding to the SPR-processed image data 35), and the Y address indicates the position in the vertical direction (the direction corresponding to the direction in which the data lines are extended in the display panel 1) in the SPR-processed image. When the grayscale values $D_{SPR}^R$, $D_{SPR}^G$ and $D_{SPR}^B$ of the R, G and B subpixels of each pixel are described with m bits in the SPR-processed image data 35 for m being an integer of two or more, each element of the dither table 53 has an m-bit value, and the dither value $D_{DITHER}$ also has an m-bit value. In this case, the number of the elements of the dither table 53 is $2^m$.

In this embodiment, in which the grayscale values $D_{SPR}^R$, $D_{SPR}^G$ and $D_{SPR}^B$ of the R, G and B subpixels of each pixel are described with eight bits in the SPR-processed image data 35, each element of the dither table 53 takes an eight-bit value selected from "0" to "255". The dither table 53 has elements of 16 rows and 16 columns. It should be noted however that, as described later In one embodiment, two or more elements may take the same value in the dither table 53 of the eight-color halftoning circuitry 48 illustrated in FIG. 11. In this embodiment, in which the dither table 53 has elements of 16 rows and 16 columns, the LUT circuitry 51 selects the dither value $D_{DITHER}$ from the 256 elements of the dither table 53 in response to the lower four bits of the X address of the pixel of interest and the lower four bits of the Y address.

The adder circuitry 52 receives the SPR-processed image data 35 from the subpixel rendering circuitry 47 and adds the dither value supplied from the LUT circuitry 51 to the grayscale value of each subpixel of each pixel described in the SPR-processed image data 35. In one embodiment, for the R, G and B subpixels of the pixel of interest described in the SPR-processed image data 35, the adder circuitry 52 calculates the sums $SUM^R$, $SUM^G$ and $SUM^B$ in accordance with the following expressions (21a) to (1c):

$$SUM^R = D_{SPR}^R + D_{DITHER} \quad ,(21a)$$

$$SUM^G = D_{SPR}^G + D_{DITHER}, \text{ and} \quad (21b)$$

$$SUM^B = D_{SPR}^B + D_{DITHER} \quad ,(21c)$$

where $D_{SPR}^R$ is the grayscale value of the R subpixel of the pixel of interest described in the SPR-processed image data 35, $D_{SPR}^G$ is the grayscale value of the G subpixel of the pixel of interest, and $D_{SPR}^B$ is the grayscale value of the B subpixel of the pixel of interest. The most significant bits of the sums $SUM^R$, $SUM^G$ and $SUM^B$ are output as the binary image data 36. It should be noted that each of the sums $SUM^R$, $SUM^G$ and $SUM^B$ is a nine-bit value in this embodiment, in which each of the grayscale values $D_{SPR}^R$, $D_{SPR}^G$ and $D_{SPR}^B$ of the R, G and B subpixels described in the SPR-processed image data 35 is an eight-bit value and the dither value $D_{DITHER}$ is also an eight-bit value. The binary image data 36 indicates whether each of the R, G and B subpixels of each pixel is to be "turned on" or "turned off" with one bit, and the bits $D_{BN}^R$, $D_{BN}^G$ and $D_{BNB}$ of the binary image data 36, which respectively correspond to the R, G and B subpixels of the pixel of interest, can be represented by the following expressions (22a) to (22c):

$$D_{BN}^R = MSB[SUM^R], \quad (22a)$$

$$D_{BN}^G = MSB[SUM^G], \text{ and} \quad (22b)$$

$$D_{BN}^{B}=MSB[\mathrm{SUM}^{B}]. \tag{22c}$$

In the eight-color halftoning circuitry 48 illustrated in FIG. 11, the frequency distribution of the values of the elements of the dither table 53 is specially designed to provide the eight-color halftoning circuitry 48 with the gamma characteristics of a desired gamma value. It is possible to achieve a dithering process of various gamma characteristics by appropriately designing the frequency distribution of the dither table used for the dither process. In this specification, the frequency distribution of the values of the elements of a dither table means the distribution of the number N(p) of the elements having a value of p. In general, a dither table used in a dithering process is determined so that the number of elements taking each allowed value is one, that is, N(p)=1 for any q. FIG. 9 illustrates such a 16-row-16-column dither table, and the dithering process using the dither table illustrated in FIG. 9 has gamma characteristics of a gamma value of one as described above. In contrast, use of a dither table in which the frequency distribution is uneven (that is, the number N(p) of the elements having a value of p depends on p) allows performing various image processing in accompany with the dithering process. Note that, there are integers $p_1$ and $p_2$ from zero to $2^m-1$, for which the numbers $N(p_1)$ and $N(p_2)$ of elements taking values $p_1$ and $p_2$ are different in the dither table, when the frequency distribution is uneven.

Discussed below is an example in which an eight-color halftoning process based on a dithering process is performed on the SPR-processed image data 35 which describe the grayscale values $D_{SPR}^{R}$, $D_{SPR}^{G}$ and $D_{SPR}^{B}$ of the R, G and B subpixels, by using an m-bit dither values $D_{DITHER}$. The bit $B_{BN}^{k}$ of the binary image data 36 is calculated as the most significant bit of the sum $D_{SPR}^{k}+D_{DITHER}$, where k is any of "R", "G" and "B". In this case, the effective brightness level of a subpixel in the display image becomes $(q/2^m)$ times of the allowed maximum brightness level when the values of the elements of the dither table 53 are determined so that q of the $2^m$ elements of the dither table 53 have a value equal to or more than $2^m-p$, for any allowed value p of the grayscale value $D_{SPR}^{k}$ of each subpixel. In some embodiments, it is possible to achieve an eight-color halftoning process of the gamma characteristics of a gamma value γ, by defining q in accordance with the following expression (23):

$$q = \mathrm{floor}\left((2^m-1)\cdot\left(\frac{p}{2^m-1}\right)^{\gamma}+0.5\right) \tag{23}$$

where floor(x) is the floor function which gives the greatest integer that is less than or equal to x. The addition of the value 0.5 and the floor function floor(x) are merely introduced to provide rounding to an integer. The rounding may be achieved with a different method.

When m is eight and the grayscale value $D_{SPR}^{k}$ of a certain subpixel is 186, the brightness level of the subpixel is to be set to 0.5 (=128/256) times of the allowed maximum brightness level, to achieve the gamma characteristics of a gamma value of 2.2. In this case, the desired brightness level can be achieved for the subpixel, by defining p as 186 and q as 128, and designing the dither table 53 so that 128 of the 256 elements of the dither table 53 have a value equal to or more than 70.

FIG. 12 illustrates one example of the values of the respective elements of the dither table 53 for m being eight, when an eight-color halftoning process of the gamma characteristics of a gamma value γ of 2.2 is performed. The dither table 53 illustrated in FIG. 12 is determines so that q of the $2^m$ elements of the dither table 53 have a value equal to or more than $2^m-p$ for any of the allowed value p of the grayscale value $D_{SPR}^{k}$ of each subpixel, for q defined in accordance with the following expression (24):

$$q = \mathrm{floor}\left(255\left(\frac{p}{255}\right)^{2.2}+0.5\right) \tag{24}$$

More specifically, the dither table 53 illustrated in FIG. 12 is obtained by performing a conversion on the dither table illustrated in FIG. 9 in accordance with the following expression (25):

$$\beta(i,j) = \mathrm{floor}\left[256-255\cdot\left(\frac{\alpha(i,j)}{255}\right)^{(1/2.2)}+0.5\right] \tag{25}$$

where α(i, j) is the value of the element in the i-th row and the j-th column of the dither table illustrated in FIG. 9, β(i, j) is the value of the element in the i-th row and the j-th column of the dither table 53 illustrated in FIG. 12, and floor(x) is the floor function which gives the greatest integer equal to or less than x. The use of the dither table 53 illustrated in FIG. 12 allows the eight-color halftoning circuitry 48 illustrated in FIG. 11 to perform a dithering process of a gamma value γ of 2.2.

In some embodiments, when the grayscale value $D_{SPR}^{k}$ of each subpixel described in the SPR-processed image data 35 is an m-bit value and the dither value is also an m-bit value, a dither table 53 which achieves a dithering process of a gamma value γ can be generated through the following procedure:

(1) Generate a first dither table in which the number of elements taking each allowed value is one (that is, N(p)=1 for any q), through a commonly-used method. Note that the first dither table has $2^m$ elements; and (2) perform conversion on the first dither table thus generated in accordance with the following expression (26):

$$\beta(i,j) = \mathrm{floor}\left[2^m-2^{m-1}\cdot\left(\frac{\alpha(i,j)}{2^{m-1}}\right)^{(1/\gamma)}+0.5\right] \tag{26}$$

where α(i, j) is the value of the element in the i-th row and the j-th column of the first dither table, and β(i, j) is the value of the element in the i-th row and the j-th column of the second dither table obtained by this conversion.

Figure 13:
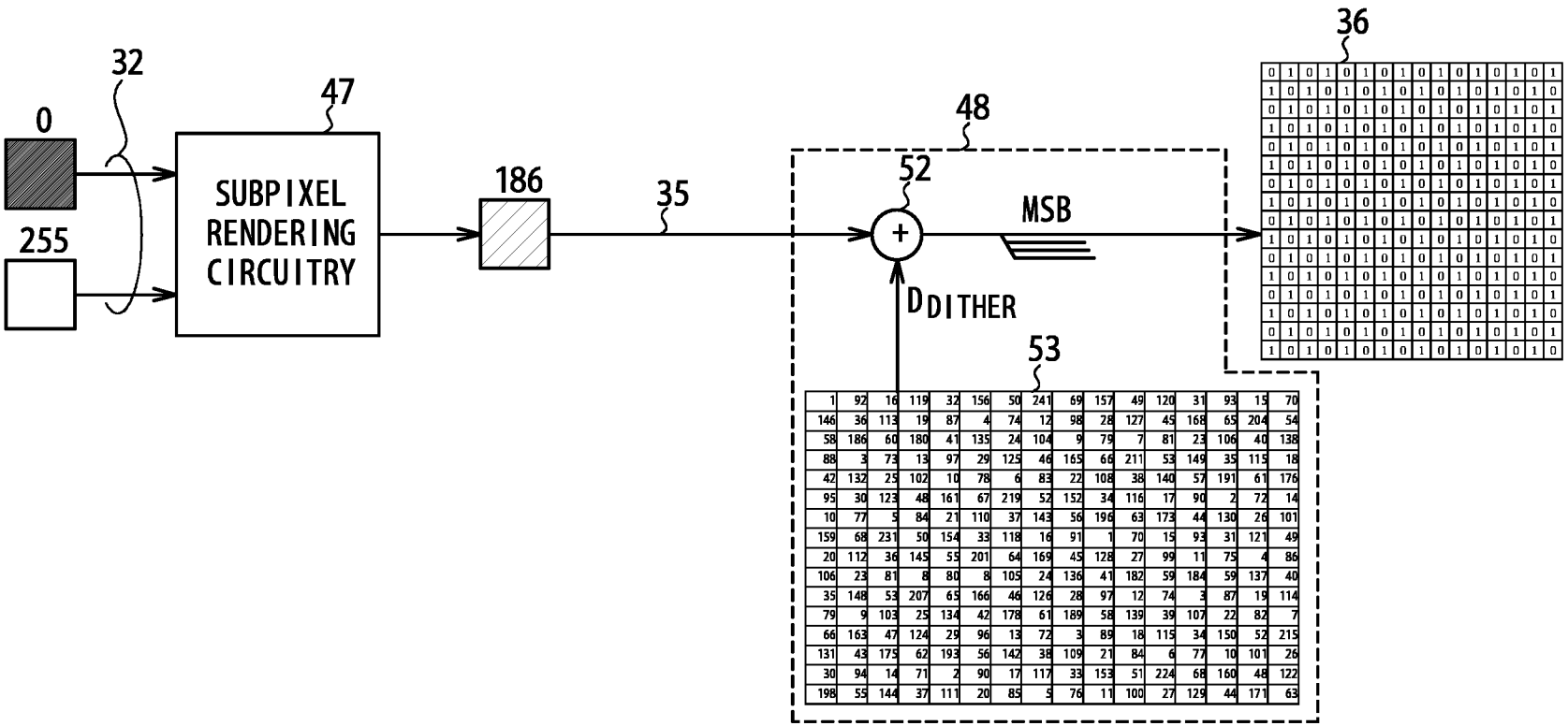
FIGS. 13 and 14 schematically illustrate one example of the subpixel rendering process and the eight-color halftoning process performed in an image processing circuitry according to one or more embodiments.
Figure 14:
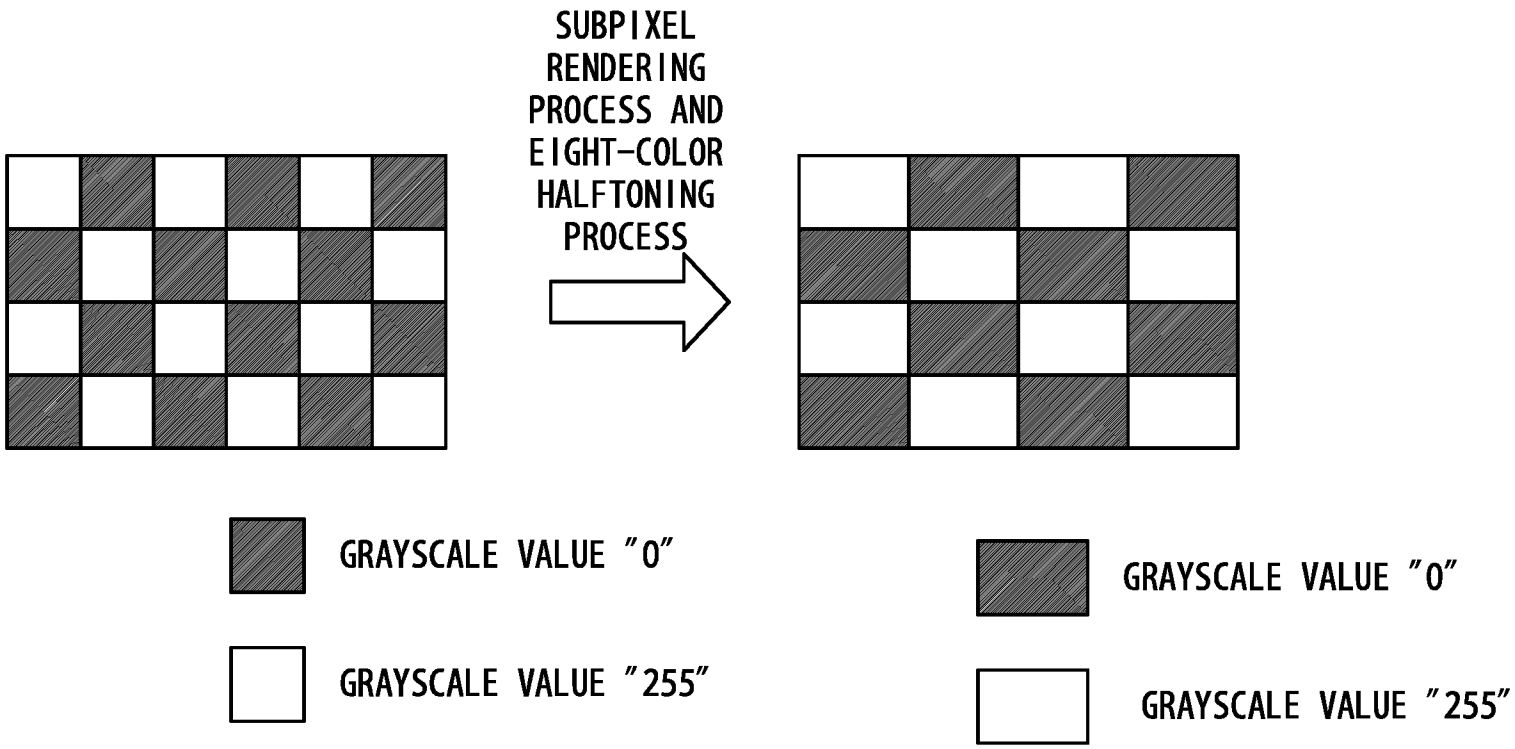

FIGS. 13 and 14 schematically illustrate one example of the subpixel rendering process and the eight-color halftoning process performed in the image processing circuitry 42 in this embodiment. In the example illustrated in FIGS. 13 and 14, the image data 32 correspond to an original image in which pixels for which the grayscale values $D_{SPR}^{k}$ of the respective subpixels (the R subpixel, G subpixel and B subpixel) are all equal to the allowed minimum grayscale value "0" and pixels for which the grayscale values $D_{SPR}^{k}$ of the respective subpixels (the R subpixel, G subpixel and B subpixel) are all equal to the allowed maximum grayscale value "255" are alternately arranged. In the subpixel rendering process in the subpixel rendering circuitry 47, the grayscale value of each subpixel of each pixel of the SPR-processed image data 35 is calculated from the grayscale values of the respective subpixels of two adjacent pixels in the original image so that the brightness level is averaged. As a result, the grayscale value of each subpixel of each pixel of the SPR-processed image data 35 is calculated as "186" in one example.

An eight-color halftoning process is then performed on the SPR-processed image data 35 by the eight-color halftoning circuitry 48. In the eight-color halftoning circuitry 48, the eight-color halftoning process is performed with the gamma characteristics of a gamma value of 2.2. As described above, when the grayscale value $D_{SPR}^{k}$ of each subpixel is described as 186 in the SPR-processed image data 35, the brightness level of each subpixel is to be 50% (≈128/255) for the gamma characteristics of the gamma value of 2.2.

In this embodiment, the LUT circuitry 51 selects the dither value $D_{DITHER}$ to be supplied to the adder circuitry 52 from the elements of the dither table 53 illustrated in FIG. 12. As described above, the values of the respective elements of the dither table 53 illustrated in FIG. 12 are determined in the frequency distribution which achieves the gamma characteristics of a gamma value of 2.2. The adder circuitry 52 adds the dither value $D_{DITHER}$ received from the LUT circuitry 51 to the grayscale value $D_{SPR}^{k}$ of each subpixel and to calculate the sum $SUM^{k}$. The bit $D_{BN}^{k}$ associated with the subpixel of the color k of the binary image data 36 is determined as the most significant bit of the sum $SUM^{k}$.

Discussed in the following is the case where the above-described process is performed on the grayscale value $D_{SPR}^{k}$ of each subpixel described in the SPR-processed image data 35 for pixels arrayed in 16 rows and 16 columns. When the dither table 53 illustrated in FIG. 12 is used and the grayscale value $D_{SPR}^{k}$ of each subpixel is "186", the bit $D_{BN}^{k}$ is calculated as a value of "1" with respect to 128 of the 16×16 pixels. This is because the most significant bit of the sum $SUM^{k}$ is "1" with respect to the 128 of the 16×16 pixels, when the dither value $D_{DITHER}$ is selected from the elements of the dither table 53 illustrated in FIG. 12. Accordingly, the subpixel of each color k is "turned on" in the 128 of the 16×16 pixels. This implies that the effective brightness level of the subpixels of each color k of the pixels is 50% of the allowed maximum brightness level in the displayed image. Accordingly, the eight-color halftoning process of this embodiment achieves the gamma characteristics of a gamma value of 2.2, appropriately representing the brightness level of each pixel in the displayed image.

As discussed above, this embodiment provides image data processing technology which achieves both of a subpixel rendering process and an eight-color halftoning process. The eight-color halftoning of this embodiment allows representing spatial changes in the grayscale value in the displayed image and appropriately representing the brightness level of each pixel in the displayed image.

Although embodiments of the present disclosure have been specifically described in the above, it would be understood to a person skilled in the art that the technologies of the present disclosure may be implemented with various modifications.

What is claimed is:

1. A method for driving a display panel, the method comprising:

determining, by squaring input grayscale values, input-side squared grayscale values for pixels of input image data, wherein squaring the input grayscale values comprises squaring a first input grayscale value of the input grayscale values and squaring a second input grayscale value of the input grayscale values;

calculating a first processed grayscale value based on the first squared input grayscale value and the second squared input grayscale value;

generating output image data by independently correcting the input-side squared grayscale values based on correction values; and driving the display panel based on the output image data.

2. The method of claim 1, wherein squaring the input grayscale values comprises squaring a third input grayscale value of the input grayscale values, and wherein calculating the first processed grayscale value is further based on the third squared input grayscale value.

3. The method of claim 2, wherein squaring the input grayscale values further comprises squaring a fourth input grayscale value of the input grayscale values, and wherein the method further comprises:

calculating a second processed grayscale value based on the third squared input grayscale value, and the fourth squared input grayscale value.

4. The method of claim 1 further comprising:

determining the correction values based on a correction parameter and the input grayscale values.

5. The method of claim 4, wherein determining the correction values comprises:

determining a first correction value of the correction values based on a combination of the first input grayscale value of the input grayscale values, the second input grayscale value of the input grayscale values, and a third input grayscale value of the input grayscale values, and the correction parameter, the first correction value is associated with a first pixel of the display panel.

6. The method of claim 5, wherein determining the correction values further comprises:

determining a second correction value of the correction values based on a combination of the third input grayscale value and a fourth input grayscale value of the input grayscale values, and the correction parameter, the second correction value is associated with a second pixel of the display panel.

7. The method of claim 6, wherein the first input grayscale value corresponds to the first pixel, the second input grayscale value corresponds to the second pixel, the third input grayscale value corresponds to a third pixel of the display panel, and the fourth input grayscale value corresponds to a fourth pixel of the display panel.

8. A display driver comprising:

subpixel rendering (SPR) circuitry configured to:

determine, by squaring input grayscale values, input-side squared grayscale values for pixels of an input image, wherein squaring the input grayscale values comprises squaring a first input grayscale value of the input grayscale values and squaring a second input grayscale value of the input grayscale values;

calculate a first processed grayscale value based on the first squared input grayscale value and the second squared input grayscale value;

generate output image data by independently correcting the input-side squared grayscale values based on correction values; and drive circuitry configured to drive a display panel based on the output image data.

9. The display driver of claim 8, wherein squaring the input grayscale values comprises squaring a third input grayscale value of the input grayscale values, and wherein the SPR circuitry is further configured to:

calculate the first processed grayscale value further based on the third squared input grayscale value.

10. The display driver of claim 9, wherein squaring the input grayscale values further comprises squaring a fourth input grayscale value of the input grayscale values, and wherein the SPR circuitry is further configured to:

calculate a second processed grayscale value based on the third squared input grayscale value, and the fourth squared input grayscale value.

11. The display driver of claim 8, wherein the SPR circuitry is further configured to determine the correction values based on a correction parameter and the input grayscale values.

12. The display driver of claim 11, wherein determining the correction values comprises:

determining a first correction value of the correction values based on a combination of the first input grayscale value of the input grayscale values, the second input grayscale value of the input grayscale values, and a third input grayscale value of the input grayscale values, and the correction parameter, the first correction value is associated with a first pixel of the display panel.

13. The display driver of claim 12, wherein determining the correction values further comprises:

determining a second correction value of the correction values based on a combination of the third input grayscale value and a fourth input grayscale value of the input grayscale values, and the correction parameter, the second correction value is associated with a second pixel of the display panel.

14. The display driver of claim 13, wherein the first input grayscale value corresponds to the first pixel, the second input grayscale value corresponds to the second pixel, the third input grayscale value corresponds to a third pixel of the display panel, and the fourth input grayscale value corresponds to a fourth pixel of the display panel.

15. A display device comprising:

a display panel; and a display driver configured to:

determine, by squaring input grayscale values, input-side squared grayscale values for pixels of an input image, wherein squaring the input grayscale values comprises squaring a first input grayscale value of the input grayscale values and squaring a second input grayscale value of the input grayscale values;

calculate a first processed grayscale value based on the first squared input grayscale value and the second squared input grayscale value;

generate output image data by independently correcting the input-side squared grayscale values based on correction values; and drive the display panel based on the output image data.

16. The display device of claim 15, wherein squaring the input grayscale values comprises squaring a third input grayscale value of the input grayscale values, and wherein the display driver is further configured to:

calculate the first processed grayscale value further based on the third squared input grayscale value.

17. The display device of claim 16, wherein squaring the input grayscale values further comprises squaring a fourth input grayscale value of the input grayscale values, and wherein the display driver is further configured to:

calculate a second processed grayscale value based on the third squared input grayscale value, and the fourth squared input grayscale value.

18. The display device of claim 15, wherein the display driver is further configured to determine the correction values based on a correction parameter and the input grayscale values.

19. The display device of claim 18, wherein determining the correction values comprises:

determining a first correction value of the correction values based on a combination of the first input grayscale value of the input grayscale values, the second input grayscale value of the input grayscale values, and a third input grayscale value of the input grayscale values, and the correction parameter, the first correction value is associated with a first pixel of the display panel.

20. The display device of claim 19, wherein determining the correction values further comprises:

determining a second correction value of the correction values based on a combination of the third input grayscale value and a fourth input grayscale value of the input grayscale values, and the correction parameter, the second correction value is associated with a second pixel of the display panel.

* * * * *